US010604326B2

(12) United States Patent
Longley et al.

(10) Patent No.: US 10,604,326 B2
(45) Date of Patent: Mar. 31, 2020

(54) PALLET COVER COMPRISING ONE OR MORE TEMPERATURE-CONTROL MEMBERS AND KIT FOR USE IN MAKING THE PALLET COVER

(71) Applicant: Cold Chain Technologies, Inc., Holliston, MA (US)

(72) Inventors: Amanda Longley, Hudson, MA (US); Geoffrey Kaiser, Westborough, MA (US); James Robert Chasteen, Grosse Pointe Farms, MI (US); Shreyas S. Panse, Boston, MA (US); Richard M. Formato, Grafton, MA (US)

(73) Assignee: COLD CHAIN TECHNOLOGIES, LLC., Franklin, MA (US)

( * ) Notice: Subject to any disclaimer, the term of this patent is extended or adjusted under 35 U.S.C. 154(b) by 52 days.

(21) Appl. No.: 15/287,631

(22) Filed: Oct. 6, 2016

(65) Prior Publication Data

US 2017/0096283 A1 Apr. 6, 2017

Related U.S. Application Data

(60) Provisional application No. 62/237,742, filed on Oct. 6, 2015, provisional application No. 62/400,015, filed on Sep. 26, 2016.

(51) Int. Cl.
*B65D 81/38* (2006.01)
*B65D 19/38* (2006.01)
(Continued)

(52) U.S. Cl.
CPC ..... *B65D 81/38* (2013.01); *B65D 19/38* (2013.01); *B65D 81/3897* (2013.01);
(Continued)

(58) Field of Classification Search
CPC ..... B65D 81/38; B65D 81/3862; B65D 81/3813; B65D 81/3818; B65D 81/3825; B65D 81/383; B65D 81/3897
(Continued)

(56) References Cited

U.S. PATENT DOCUMENTS 3,950,789 A 4/1976 Konz et al.
4,000,815 A 1/1977 Wingbro et al.
(Continued)

FOREIGN PATENT DOCUMENTS

AU 705627 B2 5/1999
CA 2371456 C 4/2009
(Continued)

OTHER PUBLICATIONS

BusinessWire article entitled "Cold Chain Technologies Responds to Envirotainer's Resized RKN t2 Pallet Shipper," (2009); https://www.businesswire.com/news/home/20090306005069/en/Cold-Chain-Technologies-Responds-Envirotainers-Resized-RKN.
(Continued)

*Primary Examiner* — Joel M Attey
(74) *Attorney, Agent, or Firm* — Kriegsman & Kriegsman

(57) ABSTRACT

A pallet cover suitable for use in covering at least a portion of a payload on a pallet and a kit for use in making the pallet cover. In one embodiment, the pallet cover includes a top wall, a front wall, a rear wall, a left side wall, and a right side wall, wherein the walls are detachably joined to one another. Each of the top wall, the front wall, the rear wall, the left side wall, and the right side wall includes a first fabric sheet and a second fabric sheet, the first and second fabric sheets being joined together to form a plurality of pockets. Each pocket may removably receive a temperature-control member containing a phase-change material. At least one of the top wall,
(Continued)

the front wall, the rear wall, the left side wall and the right side wall includes a plurality of detachably joined portions.

16 Claims, 17 Drawing Sheets

(51) Int. Cl.
*F28D 15/02* (2006.01)
*F28F 23/00* (2006.01)
*F28D 20/00* (2006.01)

(52) U.S. Cl.
CPC ..... *F28D 15/02* (2013.01); *F28F 23/00* (2013.01); *B65D 81/383* (2013.01); *B65D 81/3813* (2013.01); *B65D 81/3818* (2013.01); *B65D 81/3825* (2013.01); *B65D 81/3862* (2013.01); *B65D 2519/00189* (2013.01); *F28D 2020/0017* (2013.01)

(58) Field of Classification Search
USPC ..... 165/46; 62/371–372, 60; 220/592.23
See application file for complete search history.

(56) References Cited

U.S. PATENT DOCUMENTS 4,311,022 A 1/1982 Hall
4,324,111 A 4/1982 Edwards
4,377,075 A 3/1983 Russo
4,399,668 A 8/1983 Williamson
4,413,481 A 11/1983 Thomas
4,442,162 A 4/1984 Kuester
4,585,003 A 4/1986 Meistrell
4,676,247 A 6/1987 Van Cleve
4,688,572 A 8/1987 Hubbard et al.
4,700,706 A 10/1987 Muench
4,846,176 A 7/1989 Golden
4,892,226 A 1/1990 Abtahi
H759 H 4/1990 Jones
4,986,089 A 1/1991 Raab
4,989,418 A 2/1991 Hewlett
5,005,374 A 4/1991 Spitler
5,020,711 A 6/1991 Kelley
5,088,487 A 2/1992 Turner
5,226,557 A 7/1993 Nelson
5,237,838 A 8/1993 Merritt-Munson
5,270,550 A 12/1993 Martorana et al.
5,304,216 A 4/1994 Wallace
5,305,471 A 4/1994 Steele et al.
5,313,809 A 5/1994 Isaacson et al.
5,314,087 A 5/1994 Shea
5,361,603 A 11/1994 Merritt-Munson
5,361,605 A 11/1994 Pizzi et al.
5,409,500 A 4/1995 Dyrek
5,417,082 A 5/1995 Foster et al.
5,595,069 A 1/1997 Gies
5,638,979 A 6/1997 Shea
5,641,325 A 6/1997 Delk et al.
5,669,233 A 9/1997 Cook et al.
5,770,295 A 6/1998 Alderman
5,840,080 A 11/1998 Der Ovanesian
5,857,778 A 1/1999 Ells
5,881,908 A 3/1999 Hays et al.
5,887,437 A 3/1999 Maxim
5,899,088 A 5/1999 Purdum
5,906,290 A 5/1999 Haberkom
5,934,100 A 8/1999 Hornick
5,950,450 A 9/1999 Meyer et al.
5,953,928 A 9/1999 Saia, III et al.
5,987,910 A 11/1999 Kothe et al.
6,016,664 A 1/2000 Larsson et al.
6,036,047 A 3/2000 Dobbie
6,114,003 A 9/2000 Gottfried
6,116,042 A 9/2000 Purdum
6,128,915 A 10/2000 Wagner
6,223,551 B1 5/2001 Mitchell
6,276,164 B1 8/2001 Santa Cruz et al.
6,325,281 B1 12/2001 Grogan
6,412,545 B1 7/2002 Buff et al.
6,427,761 B1 8/2002 Georges
6,478,061 B2 11/2002 Haberkorn
6,482,332 B1 11/2002 Malach
6,540,085 B1 4/2003 Davies
6,558,608 B2 5/2003 Haraldsson et al.
6,584,797 B1 7/2003 Smith et al.
6,645,598 B2 11/2003 Alderman
6,685,012 B2 2/2004 Bowden et al.
6,832,562 B2 12/2004 Tabor et al.
6,901,711 B2 6/2005 Fay et al.
7,028,504 B2 4/2006 Derifield
7,083,147 B2 8/2006 Movsesian et al.
7,240,513 B1 7/2007 Conforti
7,257,963 B2 8/2007 Mayer
7,310,967 B2 12/2007 Aragon
7,328,583 B2 2/2008 Hillman et al.
7,631,799 B2 12/2009 Turvey et al.
7,641,812 B2 1/2010 Alderman
7,704,584 B2 * 4/2010 Alderman ..... C08K 3/16 165/104.19
7,721,566 B1 5/2010 Wilken
7,766,590 B2 8/2010 Mapitigama et al.
7,849,708 B2 12/2010 Goncharko et al.
7,913,511 B2 3/2011 Meyer et al.
7,919,163 B2 4/2011 Romero
7,963,397 B2 6/2011 Seagle et al.
8,074,465 B2 12/2011 Heroux et al.
8,141,328 B2 3/2012 Villers et al.
8,156,703 B2 4/2012 Alderman
8,163,363 B2 4/2012 Dummett
8,192,924 B1 6/2012 Barakat et al.
8,224,719 B2 7/2012 Seagle et al.
8,250,835 B2 8/2012 Kenneally
8,292,119 B2 10/2012 Kenneally
8,349,552 B2 1/2013 Haarmann et al.
8,499,533 B2 8/2013 Emond et al.
8,505,314 B1 8/2013 Romero
8,580,369 B2 11/2013 Emond et al.
8,607,581 B2 12/2013 Williams et al.
8,672,137 B2 3/2014 Seagle et al.
8,763,423 B2 7/2014 Tattam
8,763,886 B2 7/2014 Hall
8,781,921 B2 7/2014 Seagle et al.
8,887,515 B2 11/2014 Patstone
8,938,986 B2 1/2015 Matta et al.
8,980,397 B2 3/2015 Patberg et al.
9,045,254 B2 6/2015 Davies et al.
9,045,278 B2 6/2015 Mustafa et al.
9,151,531 B2 10/2015 Wengreen et al.
9,366,469 B2 6/2016 Chapman, Jr.
9,429,350 B2 8/2016 Chapman, Jr.
9,689,602 B2 6/2017 Emond et al.
9,707,156 B2 7/2017 Wengreen et al.
9,814,651 B2 11/2017 Wengreen et al.
9,827,529 B2 11/2017 Rebouillat et al.
9,877,894 B2 1/2018 Wengreen et al.
9,913,777 B2 3/2018 Wengreen et al.
9,944,449 B2 4/2018 Wood
9,956,140 B2 5/2018 Wengreen et al.
9,957,099 B2 5/2018 White et al.
9,981,797 B2 5/2018 Aksan et al.
2002/0043218 A1 4/2002 Butler
2002/0096445 A1 7/2002 Austin et al.
2002/0147242 A1 10/2002 Salyer et al.
2002/0164474 A1 11/2002 Buckley
2002/0185403 A1 12/2002 Russo
2003/0124318 A1 7/2003 Magill et al.
2003/0163182 A1 8/2003 Hickey
2004/0231346 A1 11/2004 Smith et al.
2004/0244413 A1 12/2004 Trinh et al.
2007/0051734 A1 3/2007 Kuhn
2008/0066490 A1 3/2008 Santeler
2008/0290086 A1 11/2008 Caterina et al.
2009/0230138 A1 9/2009 Williams et al.

(56) References Cited

U.S. PATENT DOCUMENTS

| | | | | |
|---|---|---|---|---|
| 2009/0258180 | A1 | 10/2009 | Goulet | |
| 2009/0288980 | A1 | 11/2009 | Hadala | |
| 2010/0037563 | A1 | 2/2010 | Luyten | |
| 2010/0301057 | A1 | 12/2010 | Tattam et al. | |
| 2010/0314397 | A1 | 12/2010 | Williams et al. | |
| 2011/0079330 | A1 | 4/2011 | Raine et al. | |
| 2011/0179807 | A1 | 7/2011 | Holloway et al. | |
| 2011/0185682 | A1 | 8/2011 | Rockwell et al. | |
| 2011/0186473 | A1 | 8/2011 | Rockwell et al. | |
| 2011/0248038 | A1 | 10/2011 | Mayer | |
| 2011/0290792 | A1 | 12/2011 | Krzak et al. | |
| 2012/0261278 | A1 | 10/2012 | Madzsu et al. | |
| 2013/0015184 | A1 | 1/2013 | Lake et al. | |
| 2013/0015191 | A1 | 1/2013 | Seagle et al. | |
| 2013/0015192 | A1 | 1/2013 | Seagle et al. | |
| 2013/0034732 | A1 | 2/2013 | Parker et al. | |
| 2013/0062355 | A1 | 3/2013 | Shulman | |
| 2013/0213977 | A1 | 8/2013 | Stathes et al. | |
| 2013/0255306 | A1 | 10/2013 | Mayer | |
| 2013/0289680 | A1 | 10/2013 | Hasegawa | |
| 2013/0291584 | A1 | 11/2013 | Chapman, Jr. | |
| 2014/0087105 | A1* | 3/2014 | Formato | C09K 5/063 428/35.2 |
| 2014/0138281 | A1 | 5/2014 | Emond et al. | |
| 2014/0174692 | A1 | 6/2014 | Emond et al. | |
| 2014/0190976 | A1 | 7/2014 | Imbrecht | |
| 2014/0290285 | A1 | 10/2014 | Formato et al. | |
| 2014/0311170 | A1 | 10/2014 | Mills et al. | |
| 2014/0331711 | A1 | 11/2014 | Blezard et al. | |
| 2014/0343493 | A1 | 11/2014 | Wengreen | |
| 2015/0053086 | A1 | 2/2015 | Rebouillat et al. | |
| 2015/0239639 | A1* | 8/2015 | Wenner | B65D 81/38 206/386 |
| 2015/0276297 | A1 | 10/2015 | Moore et al. | |
| 2015/0285548 | A1 | 10/2015 | Emond et al. | |
| 2015/0367604 | A1 | 12/2015 | Anderson et al. | |
| 2016/0262979 | A1 | 9/2016 | Wengreen et al. | |
| 2016/0362240 | A1 | 12/2016 | Ferracamo, Jr. | |
| 2017/0131015 | A1 | 5/2017 | Farrar | |
| 2017/0197752 | A1 | 7/2017 | Imbrecht et al. | |
| 2018/0036202 | A1 | 2/2018 | Wengreen et al. | |
| 2018/0093816 | A1 | 4/2018 | Longley et al. | |
| 2018/0320947 | A1 | 11/2018 | Jain et al. | |

FOREIGN PATENT DOCUMENTS

| | | | |
|---|---|---|---|
| CN | 104781159 | A | 7/2015 |
| DE | 8801345 | U1 | 3/1988 |
| DE | 102008004485 | A1 | 7/2009 |
| EP | 1006058 | A1 | 6/2000 |
| EP | 1534608 | A1 | 3/2004 |
| EP | 2157024 | A1 | 2/2010 |
| FR | 2928354 | A1 | 9/2009 |
| FR | 2989359 | A1 | 10/2013 |
| FR | 2994420 | A1 | 2/2014 |
| GB | 2418413 | B | 3/2008 |
| GB | 2448469 | A | 10/2008 |
| GB | 2452059 | A | 2/2009 |
| GB | 2476110 | A | 6/2011 |
| GB | 2559451 | A | 8/2018 |
| JP | H02232291 | A | 9/1990 |
| JP | 2001180767 | A | 7/2001 |
| JP | 2011046399 | A | 3/2011 |
| KR | 101507398 | B1 | 3/2015 |
| WO | 9843028 | A1 | 10/1998 |
| WO | 03073030 | A1 | 9/2003 |
| WO | 2004020311 | A1 | 3/2004 |
| WO | 2005007519 | A2 | 1/2005 |
| WO | 2005075307 | A1 | 8/2005 |
| WO | 2006043092 | A1 | 4/2006 |
| WO | 2009024804 | A1 | 2/2009 |
| WO | 2009140194 | A1 | 11/2009 |
| WO | 2013025827 | A1 | 2/2013 |
| WO | 2014070167 | A1 | 5/2014 |
| WO | 2014083320 | A1 | 6/2014 |
| WO | 2014113035 | A1 | 7/2014 |
| WO | 2014118821 | A1 | 8/2014 |
| WO | 2014185925 | A1 | 11/2014 |
| WO | 2015097788 | A1 | 7/2015 |
| WO | 2016171539 | A1 | 10/2016 |
| WO | 2017062675 | | 4/2017 |
| WO | 2017062675 | A2 | 4/2017 |
| WO | 2017072638 | A1 | 5/2017 |
| WO | 2017220953 | A1 | 12/2017 |
| WO | 2017220954 | A1 | 12/2017 |
| WO | 2018142133 | A1 | 8/2018 |
| WO | 2018167478 | A1 | 9/2018 |
| WO | 2018213348 | A2 | 11/2018 |

OTHER PUBLICATIONS

Sales literature for Envirotainer RKN t2 container, Envirotainer AB, Stockholm, Sweden (2018); https://www.envirotainer.com/en/active-containers/our-container-products/envirotainer-rkn-t2/.

Sales literature for KoolTemp insulated pallet container—ZX4500, Cold Chain Technologies, Inc., Holliston, Massachusetts (2009).

Sales literature for Foam Fabricators Airdex pallet, Scottsdale, Arizona (2018); http://www.foamfabricatorsinc.com/Page.aspx?nid=103.

Sales literature for Trip & Co. GoodCape thermal cover (2018); https://www.trip-co.nl/aircargo/products/insulation-cover/.

Sales literature for DuPont Tyvek air cargo covers for pharmaceuticals, E.I. du Pont de Nemours and Company, Wilmington, Delaware (2014).

Sales literature for CooLiner, accessed on Oct. 5, 2018 at https://ipcpack.com/pdf/cooliner-brochure.pdf, Insulated Products Corp. Rancho Dominguez, California.

Sales literature for PolarTech ICE-BRIX saddle bags/cold pockets, accessed on Oct. 5, 2018 at http://coldchain.polar-tech.com/viewitems/all-categories-food-cold-packs/ce-refrigerants-ice-brix-line-ice-brix-saddle-bags, Polar Tech Industries, Inc., Elysburg, Pennsylvania.

Energy Shield Insulated Pallet Covers' (Steel Guard) Apr. 23, 2015. Retrieved from the Internet on Dec. 6, 2016. URL: https://web.archive.org/web/20150423145914/http://www.steelguardsafety.com/insulated-pallet-covers.

Sales literature entitled "creating solutions: Pallet Thermal Protection System," CAPPI (Competences Associees en Plasturgie et Process Industriels), Auxerre, France (Jan. 2015).

International Search Report dated May 4, 2017, in corresponding PCT Application No. PCT/US16/55831.

Written Opinion dated May 4, 2017, in corresponding PCT Application No. PCT/US16/55831.

Sales literature for PalletQuilt, Q Products & Services, Hazel Crest, Illinois (2010).

Sales literature for Tyvek cargo covers, E.I.du Pont de Nemours and Company, Wilmington, Delaware (2014).

Sales literature for SilverSkin thermal pallet covers, TP3 Global, Redditch, West Midlands, UK (2017).

Sales literature for Polar Tech insulated pallet covers, Polar Tech Industries, Inc., Genoa, Illinois (2015).

International Search Report dated Aug. 13, 2018, in PCT Application No. PCT/US18/32828.

Written Opinion dated Aug. 13, 2018, in PCT Application No. PCT/US18/32828.

Literature for PalletQuilt Shipping System, Summer Packout, Cold Chain Technologies, Holliston, MA (2013).

Spec sheets for GoodCape Standard, GoodCape Light and GoodCape Extreme laminates, Trip & Co., Nieuw-Vennep, The Netherlands (2016).

* cited by examiner

PALLET COVER COMPRISING ONE OR MORE TEMPERATURE-CONTROL MEMBERS AND KIT FOR USE IN MAKING THE PALLET COVER

CROSS-REFERENCE TO RELATED APPLICATIONS

The present application claims the benefit under 35 U.S.C. 119(e) of U.S. Provisional Patent Application No. 62/237,742, filed Oct. 6, 2015, U.S. Provisional Patent Application No. 62/400,015, filed Sep. 26, 2016, the disclosures of both of which are incorporated herein by reference.

BACKGROUND OF THE INVENTION

The present invention relates generally to pallet covers and relates more particularly to pallet covers that include one or more temperature-control members.

Pallet covers that are used to help maintain pallet-sized loads of temperature-sensitive materials, such as biological and/or pharmaceutical products, within a desired temperature range for a desired period of time are well-known. Examples of such pallet covers, also sometimes referred to as "pallet blankets," are discussed below.

In U.S. Pat. No. 8,250,835 B2, inventor Kenneally, which issued Aug. 28, 2012, and which is incorporated herein by reference, there is disclosed an airtight cover assembly that includes a side panel folded around goods on a pallet presenting top and bottom opening, a top panel with a plurality of pouches positioned on an inside surface above a vented rigid plate, and a bottom panel enclosing the pallet. Hook and loop closures secure the panel assembly. Panel inner and outer surfaces of a polyvinyl chloride material bonded to an aluminum laminate enclose multiple layers of foam.

In U.S. Pat. No. 6,482,332, inventor Malach, which issued Nov. 19, 2002, and which is incorporated herein by reference, there is disclosed a phase change material that comprises 1-99.5% by weight polyol, wherein the polyol is selected from the group consisting of 1,4 butanediol and 1,6 hexanediol, 0.5-99% by weight water, and an amount of a nucleating agent sufficient to reduce super cooling of the phase change formulation. The phase change material may be placed in blankets made up of pouches of phase change material. The blankets may also be thin, flat sheets using permeable mats. Blankets of phase change material may be used to enclose entire pallets of product.

In U.S. Patent Application Publication No. US 2013/0062355 A1, inventor Shulman, which was published Mar. 14, 2013, and which is incorporated herein by reference, there are disclosed packaging and storing assemblies having phase change materials and methods of using the packaging and storage assemblies. The packaging can have a temperature barrier layer and can be used to insulate a trailer (e.g., in walls of trailer or liner inside trailer). The packaging can be in the form of reusable blankets to cover/wrap pallets or as hanging curtains/separators in a storage unit or trailer.

In U.S. Patent Application Publication No. US 2008/0066490 A1, inventor Santeler, which was published Mar. 20, 2008, and which is incorporated herein by reference, there is disclosed a compartmentalized refrigerant wrap. More specifically, according to the subject patent application publication, there is disclosed an elongated sheet having repeating compartments and intermittent sections placed after any repeating compartment. The repeating compartments are closed membranes encasing refrigerant therein.

Alternatively, the repeating compartments may be disposed with pockets for releasably retaining the refrigerant. The intermittent sections are flat in cross section and provide holes along its sides for creating a passageway therethrough. The holes may be strengthened using a grommet or the like. In use, one elongate sheet is secured to other elongated sheets in any various end-to-end and/or side-to-side combinations for creating a modular blanket of refrigerant. The sheets are secured to one another by hooks or other known means in which holes in one sheet are connected to various holes in another sheet. The refrigerant blanket may then be placed around the exterior of a large quantity of perishable goods for maintaining the temperature of the sensitive goods.

In PCT International Publication No. WO 2014/070167 A1, which was published May 8, 2014, and which is incorporated herein by reference, there is disclosed a thermal stabilization shipping system that comprises a pallet to underlie a palletized load and a blanket dimensioned to drape over a top of the palletized load and reach down to the pallet. The blanket has compartments containing a phase change material.

Other documents that may be of interest include the following, all of which are incorporated herein by reference: U.S. Pat. No. 7,919,163 B2, inventor Romero, issued Apr. 5, 2011; U.S. Pat. No. 6,478,061 B2, inventor Haberkorn, issued Nov. 12, 2002; U.S. Pat. No. 5,906,290, inventor Haberkorn, issued May 25, 1999; U.S. Patent Application No. US 2010/0037563 A1, inventor Luyten, published Feb. 18, 2010; UK Patent No. GB 2418413 B, published Mar. 19, 2008; and German Gebrauchsmuster No. DE 8801345 U1, published Mar. 31, 1988.

SUMMARY OF THE INVENTION

It is an object of the present invention to provide a novel pallet cover suitable for use in covering at least a portion of a payload on a pallet.

Therefore, according to one aspect of the invention, there is provided a pallet cover suitable for use in covering at least a portion of a payload on a pallet, the pallet cover comprising (a) a top wall; (b) a front wall; (c) a rear wall; (d) a left side wall; and (e) a right side wall; (f) wherein each of said top wall, said front wall, said rear wall, said left side wall, and said right side wall comprises at least one pocket for receiving a temperature-control member, and wherein at least one of said top wall, said front wall, said rear wall, said left side wall, and said right side wall further comprises a temperature-control member disposed in at least one of said pockets, and wherein at least one of said top wall, said front wall, said rear wall, said left side wall and said right side wall has an adjustable length.

According to a more detailed feature of the invention, each of said front wall, said rear wall, said left side wall and said right side wall may have an adjustable length.

According to a more detailed feature of the invention, each of said front wall, said rear wall, said left side wall and said right side wall may comprise a first portion and a second portion, the first portion may have a bottom, the second portion may have a top, and the top of the second portion may be detachably joined to the bottom of the first portion.

According to a more detailed feature of the invention, the first portion and the second portion may have different lengths.

According to a more detailed feature of the invention, the second portion may be devoid of a temperature-control member.

According to a more detailed feature of the invention, each of the front wall, the rear wall, the left side wall and the right side wall may be detachably joined to the top wall.

According to a more detailed feature of the invention, each of the top wall, the front wall, the rear wall, the left side wall, and the right side wall may comprise a first fabric sheet and a second fabric sheet, the first fabric sheet and the second fabric sheet may be joined to one another to define a plurality of pockets, and each of the plurality of pockets may be suitable for holding a separate temperature-control member.

According to a more detailed feature of the invention, the pockets may have open ends, and each of the top wall, the front wall, the rear wall, the left side wall, and the right side wall may further include closures for securely yet removably retaining a temperature-control member in a pocket.

According to a more detailed feature of the invention, each of the top wall, the front wall, the rear wall, the left side wall, and the right side wall may further comprise a layer of insulation, and the second fabric sheet may be disposed between the first fabric sheet and the layer of insulation.

According to a more detailed feature of the invention, the top wall may further comprise at least one looped handle to facilitate transport of the top wall.

According to a more detailed feature of the invention, the temperature-control member may comprise a phase-change material.

According to a more detailed feature of the invention, the phase-change material may be a gelled organic phase-change material and may comprise at least one n-alkane and a gelling agent selected from the group consisting of a styrene-ethylene-butylene-styrene triblock copolymer and a styrene-ethylene-propylene-styrene triblock copolymer.

According to a more detailed feature of the invention, the above-described pallet cover may be combined with a thermal insulation wrap removably inserted over the pallet cover.

According to another aspect of the invention, there is provided a pallet cover suitable for use in covering at least a portion of a payload on a pallet, the pallet cover comprising (a) a top wall; (b) a front wall; (c) a rear wall; (d) a left side wall; and (e) a right side wall; (f) wherein at least one of said top wall, said front wall, said rear wall, said left side wall, and said right side wall comprises a first plurality of temperature-control members and at least one insulating member, the first plurality of temperature-control members arranged to circumscribe at least one void, the at least one insulating member being positioned within the at least one void.

According to a more detailed feature of the invention, each of said top wall, said front wall, said rear wall, said left side wall, and said right side wall may comprise a first plurality of temperature-control members, each of the temperature-control members may comprise a phase-change material, the temperature-control members of each of said top wall, said front wall, said rear wall, said left side wall and said right wall may be arranged to circumscribe two voids, and an insulating member may be positioned within each of the voids.

According to a more detailed feature of the invention, each of said top wall, said front wall, said rear wall, said left side wall and said right side wall may further comprise additional insulation members, and the additional insulation members may be arranged similarly to and in contact with the first plurality of temperature-control members.

According to a more detailed feature of the invention, each of said top wall, said front wall, said rear wall, said left side wall and said right side wall may further comprise an inner sheet and an outer sheet, and the first plurality of temperature control members and the insulating members may be positioned between the inner sheet and the outer sheet.

According to a more detailed feature of the invention, each of said top wall, said front wall, said rear wall, said left side wall and said right side wall may further comprise a second plurality of temperature-control members, and the second plurality of temperature-control members may be arranged similarly to and in contact with the first plurality of temperature-control members.

According to a more detailed feature of the invention, the second plurality of temperature-control members may comprise a phase-change material, and the phase-change material of the second plurality of temperature-control members may differ from the phase-change material of the first plurality of temperature-control members.

According to a more detailed feature of the invention, the pallet cover may further comprise a bottom wall, and the bottom wall may comprise a third plurality of temperature-control members.

According to a more detailed feature of the invention, each of the third plurality of temperature-control members may comprise a phase-change material, and the third plurality of temperature-control members may be arranged to circumscribe a void.

According to a more detailed feature of the invention, the void of the bottom wall may be unoccupied.

According to a more detailed feature of the invention, the phase-change material may be a gelled organic phase-change material and may comprise at least one n-alkane and a gelling agent selected from the group consisting of a styrene-ethylene-butylene-styrene triblock copolymer and a styrene-ethylene-propylene-styrene triblock copolymer.

According to a more detailed feature of the invention, the above-described pallet cover may be combined with a thermal insulation wrap removably inserted over the pallet cover.

According to yet another aspect of the invention, there is provided a pallet cover suitable for use in covering at least a portion of a payload on a pallet, the pallet cover comprising (a) a first subassembly, said first subassembly comprising (i) a central portion, (ii) a first end portion disposed at a first end of the central portion, and (iii) a second end portion disposed at a second end of the central portion; (b) a second subassembly, said second subassembly comprising (i) a central portion, (ii) a first end portion disposed at a first end of the central portion, and (iii) a second end portion disposed at a second end of the central portion; (c) wherein each of the first end portion of the first subassembly, the second end portion of the first subassembly, the central portion of the second subassembly, the first end portion of the second subassembly, and the second end portion of the second subassembly comprises at least one temperature-control member and wherein the central portion of the first subassembly is devoid of a temperature-control member; and (d) wherein the central portion of the second subassembly is mounted over the central portion of the first subassembly and wherein the first and second end portions of the first subassembly are offset relative to the first and second end portions of the second subassembly, whereby, when the pallet cover is positioned over a payload on a pallet, the central portions of the first and second subassemblies are positioned substantially over the top of the payload and the first and second end portions of the first and second subassemblies are positioned substantially along the sides of the payload.

According to a more detailed feature of the invention, the first subassembly and the second subassembly may be detachably joined to one another.

According to a more detailed feature of the invention, the first end portion of the first subassembly may be detachably joined to each of the first and second end portions of the second subassembly, and the second end portion of the first subassembly may be detachably joined to each of the first and second end portions of the second assembly.

According to a more detailed feature of the invention, the first end portion of the first subassembly may be detachably joined to each of the first and second end portions of the second subassembly with complementary hook and loop fasteners, and the second end portion of the first subassembly may be detachably joined to each of the first and second end portions of the second assembly with complementary hook and loop fasteners.

According to a more detailed feature of the invention, the first subassembly may comprise a first pair of sheets, and the first pair of sheets may be joined to one another so as to define therein the central portion, the first end portion, the second end portion, and at least one pocket in each of the first end portion and the second end portion for receiving at least one temperature-control member.

According to a more detailed feature of the invention, the second subassembly may comprise a second pair of sheets, and the second pair of sheets may be joined to one another so as to define therein the central portion, the first end portion, the second end portion, and at least one pocket in each of the central portion, the first end portion and the second end portion for receiving at least one temperature-control member.

According to a more detailed feature of the invention, each of the first and second end portions of the first subassembly and each of the central portion, the first end portion, and the second end portion of the second subassembly may comprise a plurality of pockets for receiving temperature-control members.

According to a more detailed feature of the invention, each of the temperature-control members may comprise a phase-change material.

According to a more detailed feature of the invention, the above-described pallet cover may be combined with a thermal insulation wrap removably inserted over the pallet cover.

It is another object of the present invention to provide a kit for use in making the above-described pallet cover.

Therefore, according to one aspect of the invention, there is provided a kit for use in constructing a pallet cover, the pallet cover being suitable for covering at least a portion of a payload on a pallet, the kit comprising (a) a top wall; (b) a front wall, the front wall being detachably joinable to the top wall; (c) a rear wall, the rear wall being detachably joinable to the top wall; (d) a left side wall, the left side wall being detachably joinable to each of the top wall, the front wall, and the rear wall; (e) a right side wall, the right side wall being detachably joinable to each of the top wall, the front wall, and the rear wall; and (f) a plurality of temperature-control members, each of the temperature-control members comprising a phase-change material; (g) wherein each of said top wall, said front wall, said rear wall, said left side wall, and said right side wall comprises a plurality of pockets, each of the pockets being suitable for removably receiving at least one temperature-control member.

According to a more detailed feature of the invention, at least one of said front wall, said rear wall, said left side wall, and said right side wall may comprise a plurality of detachably joinable portions.

According to a more detailed feature of the invention, each of said top wall, said front wall, said rear wall, said left side wall, and said right side wall may comprise a first fabric sheet and a second fabric sheet, and the first fabric sheet and the second fabric sheet may be joined to one another to define the pockets for holding the temperature-control members.

According to a more detailed feature of the invention, each of said top wall, said front wall, said rear wall, said left side wall, and said right side wall may further comprise a layer of insulation and a third fabric sheet, the layer of insulation may be positioned between the second fabric sheet and the third fabric sheet, and the second fabric sheet may be positioned between the first fabric sheet and the layer of insulation.

According to a more detailed feature of the invention, the kit may comprise a thermal insulation wrap dimensioned to be removably inserted over the pallet cover.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 1(*d*) is an enlarged, partly exploded, top view of a first alternative top wall for use in the pallet cover of FIG. 1;

DETAILED DESCRIPTION OF THE INVENTION

Figure 1A:
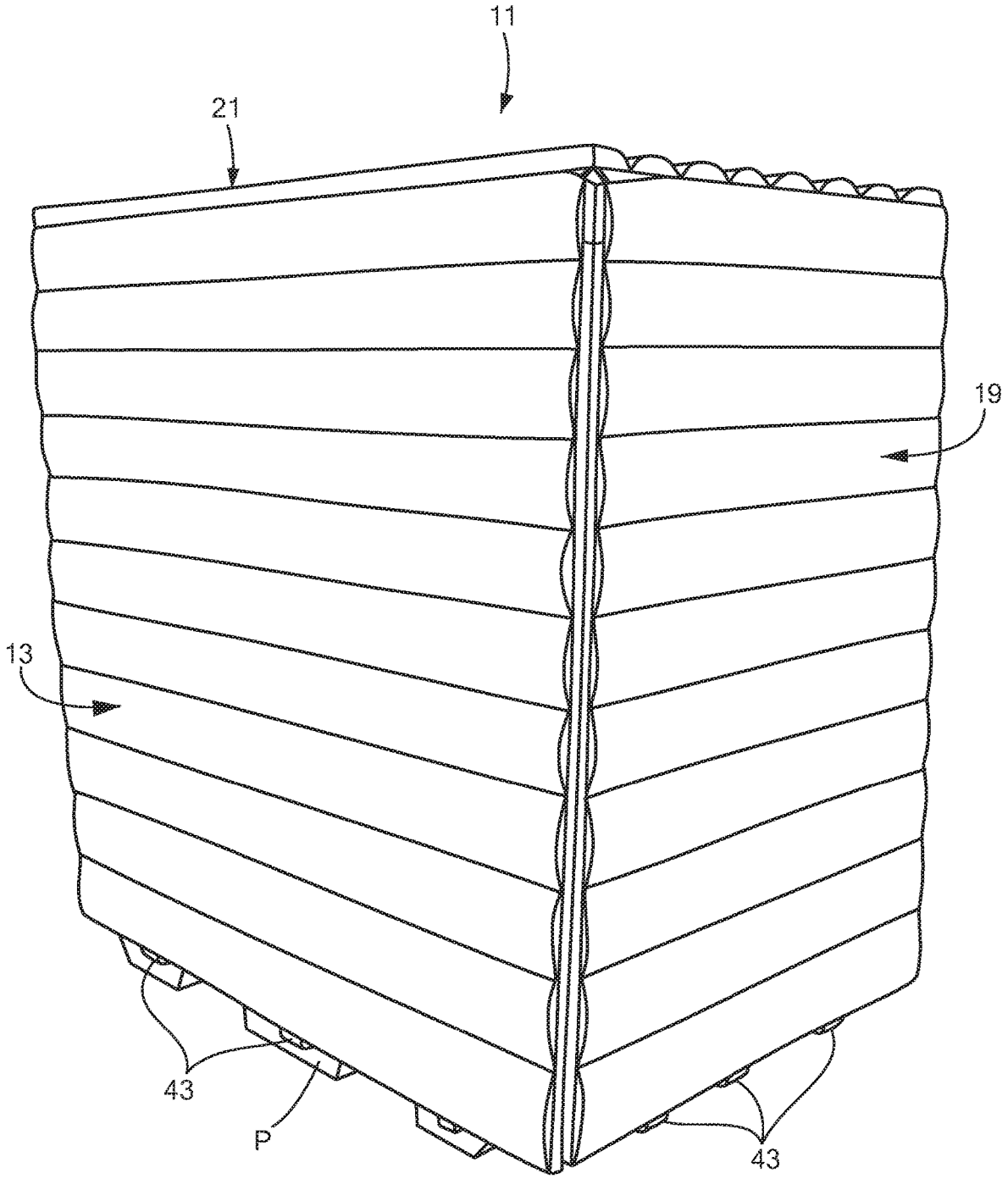
FIGS. 1(*a*) through 1(*c*) are perspective, front, and partly exploded perspective views, respectively, of a first embodiment of a pallet cover constructed according to the teachings of the present invention, the pallet cover being shown in FIGS. 1(*a*) and 1(*b*) covering a payload on a pallet.
Figure 1B:
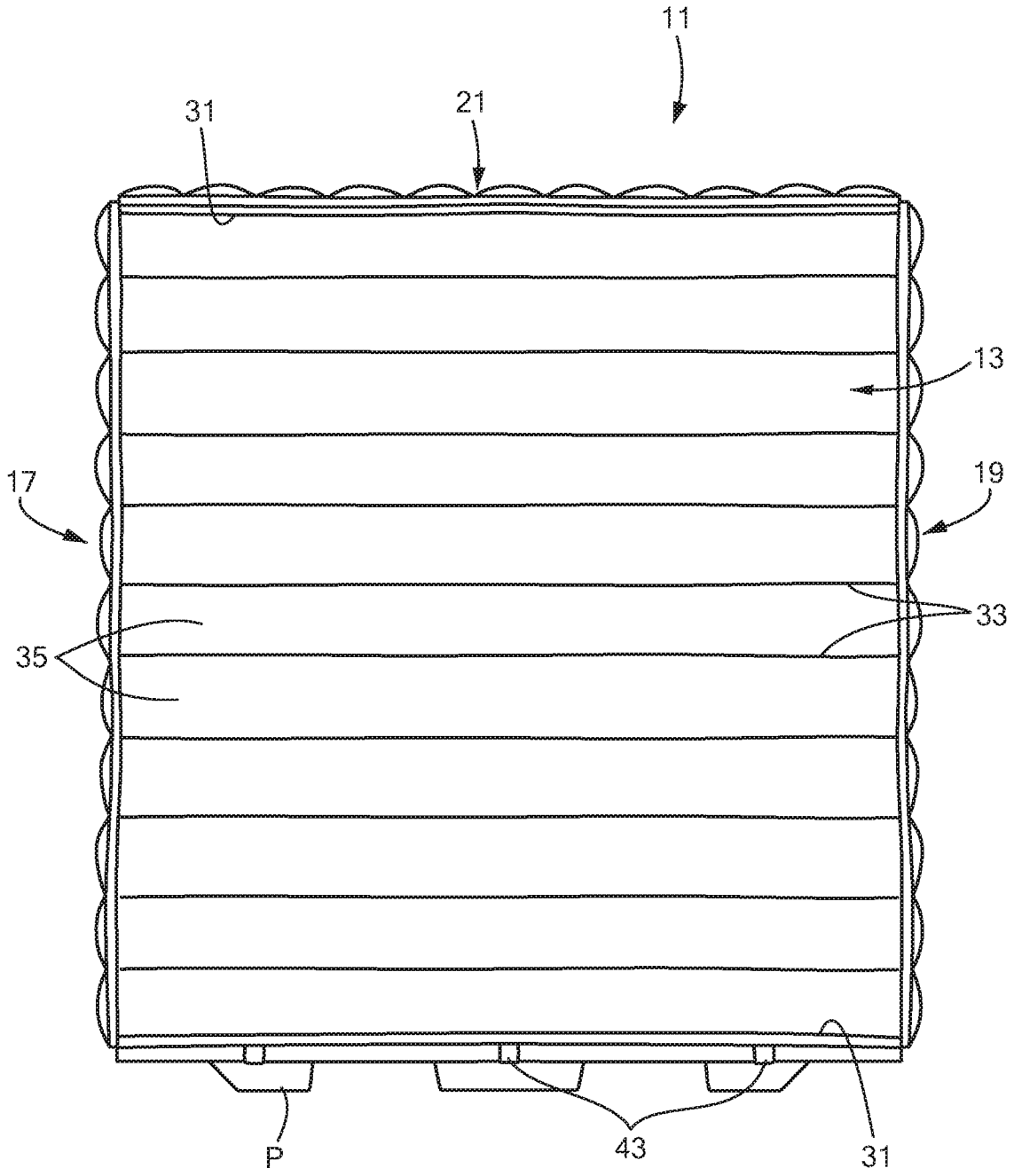
Figure 1C:
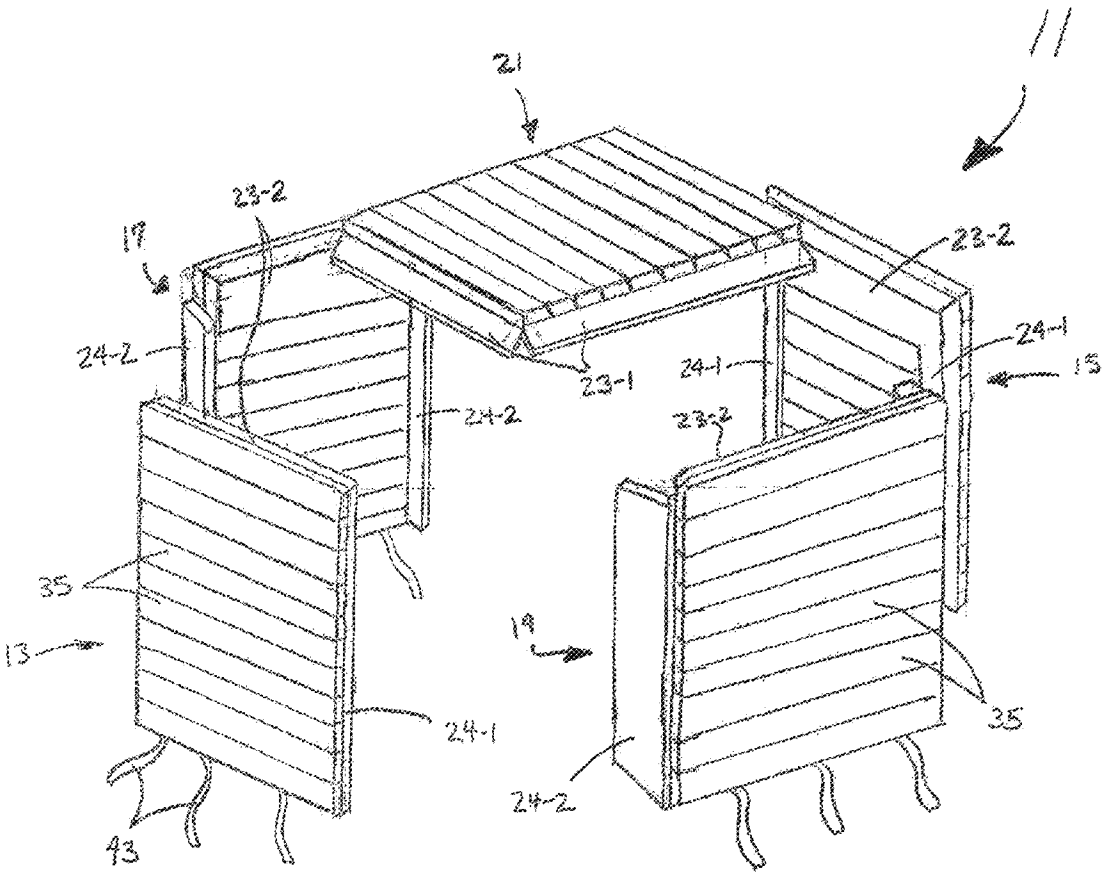
Figure 1D:
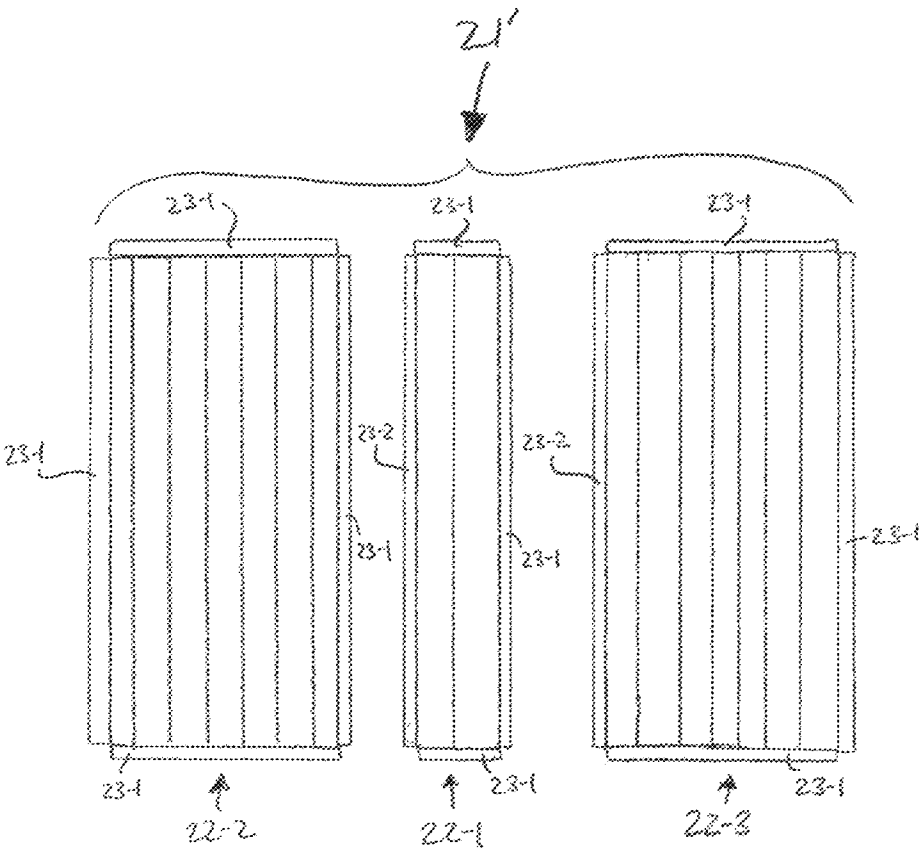

Referring now to FIGS. 1(*a*), 1(*b*), and 1(*c*), there are shown various views of a first embodiment of a pallet cover that may be used to help maintain a pallet-sized load of temperature-sensitive materials within a desired temperature range for a desired period of time, the pallet cover being constructed according to the present invention and being represented generally by reference numeral 11.

Pallet cover 11 may comprise a front wall 13, a rear wall 15, a left wall 17, a right wall 19, and a top wall 21. (In FIGS. 1(*a*) and 1(*b*), a portion of the outer layer of front wall 13 is peeled away to reveal the internal contents of front wall 13.) Front wall 13, rear wall 15, left wall 17, right wall 19, and top wall 21 may be appropriately dimensioned to cover substantially the entire front, rear, left side, right side, and top, respectively, of a pallet-sized payload. Examples of a pallet-sized payload include, but are not limited to, a 48 inch×40 inch×48 inch payload, a 48 inch×40 inch×40 inch payload, and a 48 inch×40 inch×59 inch payload. Alternatively, it should be understood that, if desired, front wall 13, rear wall 15, left wall 17, right wall 19 and top wall 21 may be dimensioned to cover only a portion of a pallet-sized payload. For example, front wall 13, rear wall 15, left wall 17, right wall 19 and top wall 21 may be dimensioned to cover only a top portion of the payload, with a bottom portion of the payload being left uncovered. Alternatively, if desired, one or more of front wall 13, rear wall 15, left wall 17, right wall 19 and top wall 21 may be constructed to have an adjustable length, for example, by being made of two or more detachably joinable portions (e.g., a 40-inch long portion and a 20-inch long portion that may be used alternatively to form a 40-inch wall portion or a 20-inch wall portion, respectively, or that may be used in combination to form a 60-inch wall portion) or by having a releasable securing mechanism to permit a bottom portion of the wall of fixed or variable size to be folded upwardly and secured to a top portion of the same wall. Moreover, as can be seen in FIG. 1(*d*), an alternative embodiment of top wall 21, namely, top wall 21' may be adjustable in length and/or width, for example, by being made of a plurality of detachably joinable portions (e.g., one or more intermediate portions 22-1 detachably joinable between end portions 22-2 and 22-3).

Referring back now to FIGS. 1(*a*) through 1(*c*), top wall 21 may be detachably joined to each of front wall 13, rear wall 15, left wall 17, and right wall 19 using suitable releasable fastening mechanisms 23-1 and 23-2, such as strips of VELCRO complementary hook and loop fasteners, zippers, buttons, snaps, releasable adhesive tapes, and the like, located on adjacent edges of top wall 21, front wall 13, rear wall 15, left wall 17, and right wall 19. In like fashion, each of front wall 13, rear wall 15, left wall 17, and right wall 19 may be detachably joined to its two neighboring side walls using suitable releasable fastening mechanisms 24-1 and 24-2, such as VELCRO complementary hook and loop fasteners, zippers, buttons, snaps, releasable adhesive tapes, and the like, located on adjacent edges of front wall 13, rear wall 15, left wall 17, and right wall 19. Notwithstanding the above, if desired, top wall 21 may be permanently secured to each of front wall 13, rear wall 15, left wall 17, and right wall 19 using a suitable permanent fastening mechanism, such as rivets, stitches, a permanent adhesive, and the like, and each of front wall 13, rear wall 15, left wall 17, and right wall 19 may be permanently secured to its two neighboring side walls using a suitable permanent fastening mechanism, such as rivets, stitches, a permanent adhesive, and the like. Moreover, if desired, front wall 13, rear wall 15, left wall 17, right wall 19 and top wall 21 may be constructed as integrally formed portions of a unitary structure.

Figure 2A:
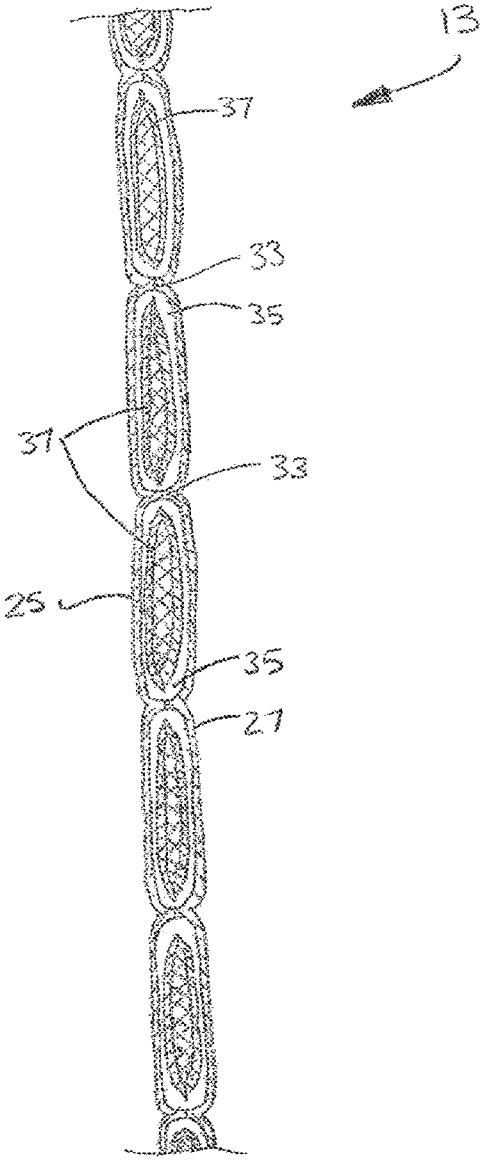
FIGS. 2(*a*) through 2(*c*) are enlarged fragmentary section, enlarged rear, and enlarged fragmentary partly exploded perspective views, respectively, of the front wall of the pallet cover shown in FIGS. 1(*a*) through 1(*c*)
Figure 2B:
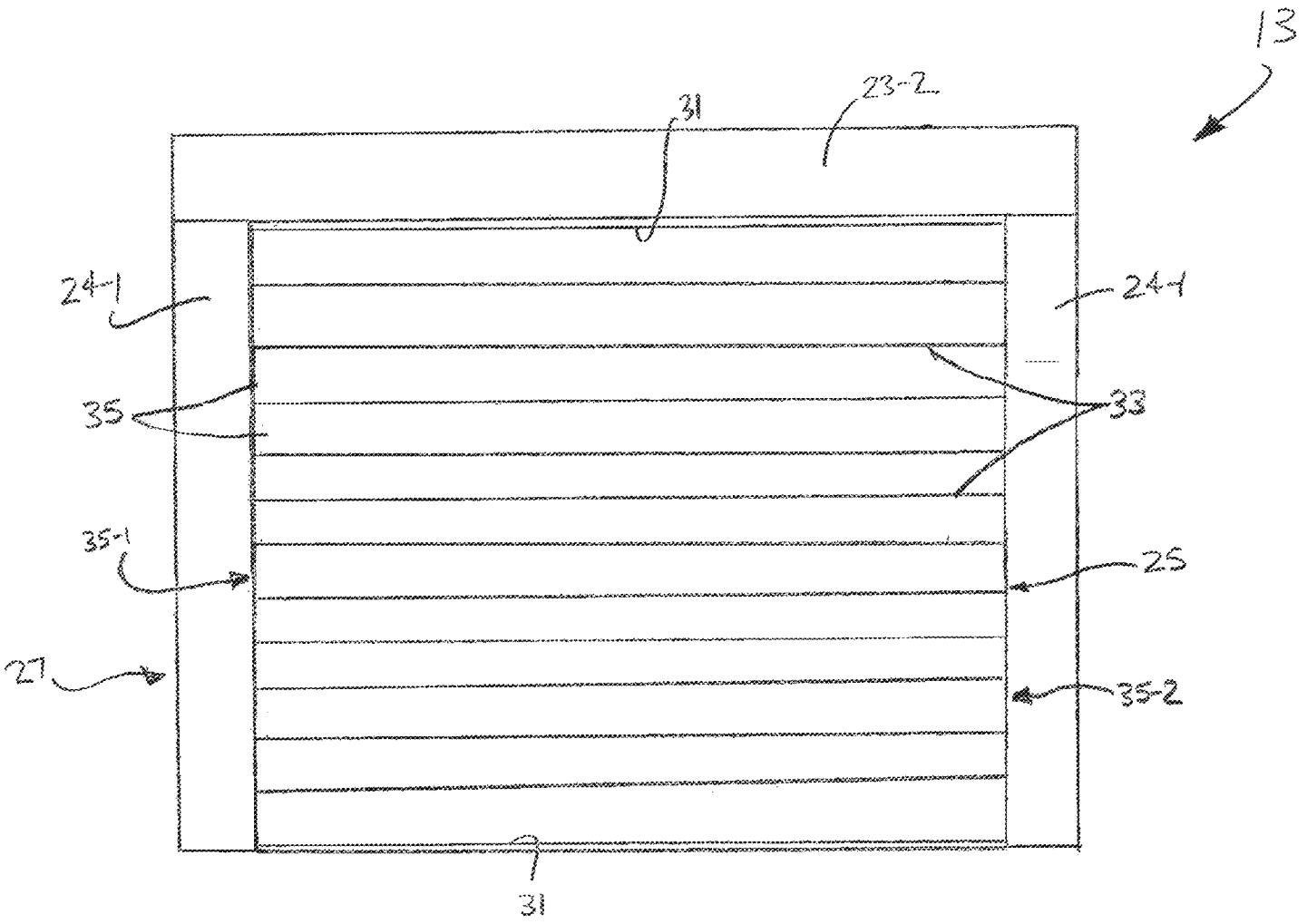
Figure 2C:
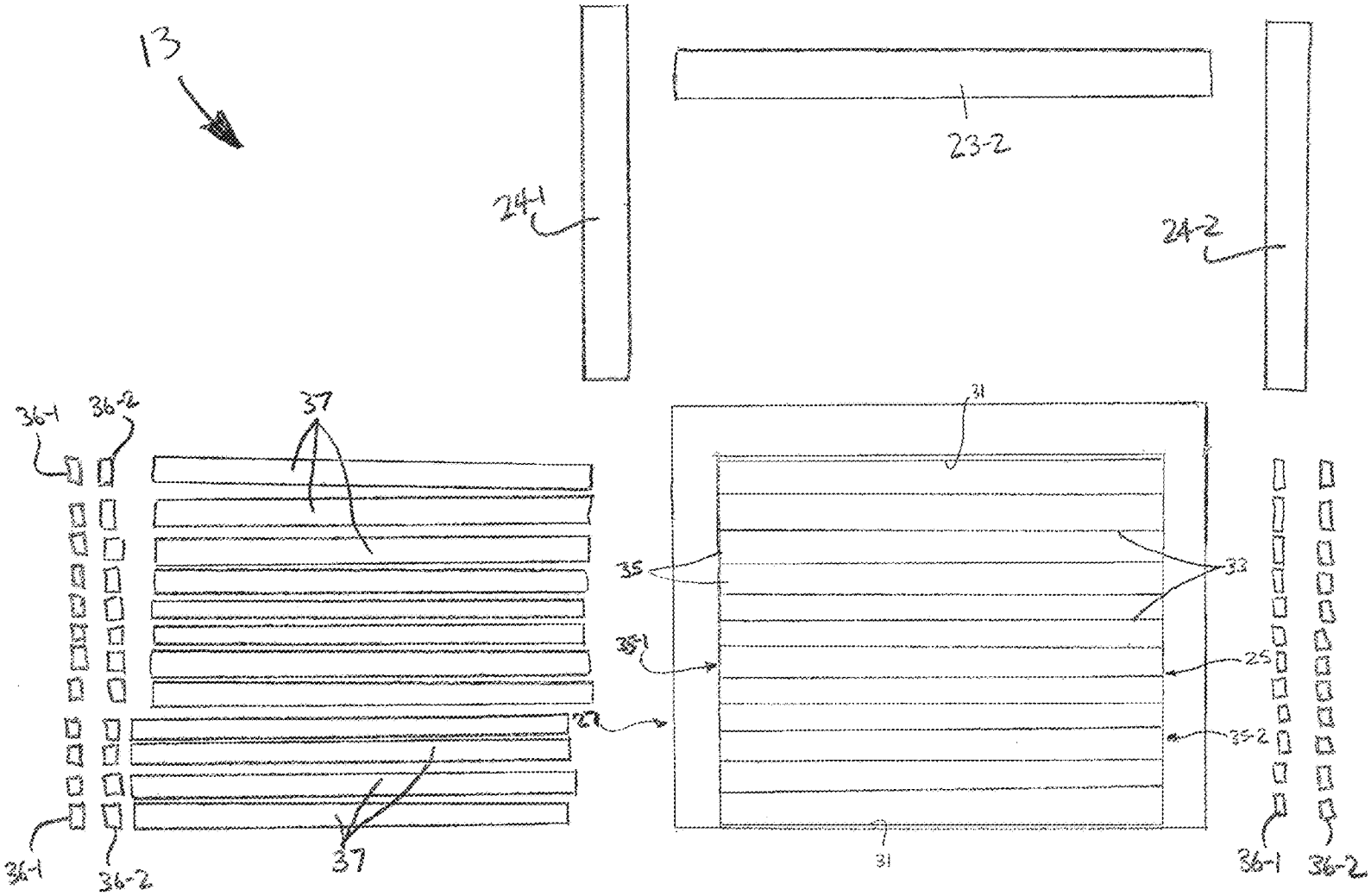

Referring now to FIGS. 2(*a*) through 2(*c*), front wall 13 is shown in greater detail. As can be seen, front wall 13 may be an assembly of components and may comprise an inwardly-facing (i.e., proximate to the payload) fabric sheet 25 and an outwardly-facing (i.e., distal to the payload) fabric sheet 27. Inwardly-facing fabric sheet 25 and outwardly-facing fabric sheet 27 may be generally rectangular sheets of generally similar size, with inwardly-facing fabric sheet 25 preferably being slightly undersized relative to outwardly-facing fabric sheet 27 so that small portions of the top and of the left and right sides of outwardly-facing fabric sheet 27 are uncovered by inwardly-facing fabric sheet 25. Each of inwardly-facing fabric sheet 25 and outwardly-facing fabric sheet 27 may be made from a suitable material. Solely for purposes of illustration and not intended as an exhaustive discussion of variations, each of sheets 25 and 27 may be a NYLON polyamide fabric sheet, each of sheets 25 and 27 may be a polyvinyl chloride (PVC) fabric sheet, each of sheets 25 and 27 may be a PVC-coated fabric sheet, sheet 25 may be a PVC fabric sheet and sheet 27 may be a PVC-coated fabric sheet or vice versa, one or more of sheets 25 and 27 may be a polyethylene fabric sheet, a polyethylene scrim, or a polyethylene terephthalate fabric sheet, such as a metalized or vinyl-coated polyethylene terephthalate fabric sheet; alternatively, sheets 25 and 27 may be any suitable combination of materials previously described. According to one particular embodiment, sheet 25 may be a PVC mesh fabric sheet, and sheet 27 may be a PVC-coated fabric sheet. A benefit to using a mesh fabric for sheet 25 is that a user may easily visually inspect whatever contents, if any, may be positioned between sheets 25 and 27. If desired, to prevent a payload that is covered by pallet cover 11 from being heated due to exposure to direct sunlight, one or both of sheets 25 and 27 may be made from a material that reflects solar radiation or may be coated with a material that reflects solar radiation; alternatively, one or both of sheets 25 and 27 may have a color that reflects solar radiation.

Inwardly-facing fabric sheet 25 and outwardly-facing fabric sheet 27 may be joined to one another along the top and bottom edges of fabric sheet 25 by a pair of outer seams 31 and may additionally be joined to one another along a plurality of generally parallel inner seams 33. Seams 31 and 33 may be formed by sewing or by other suitable means. Seams 31 and 33 may define a series of parallel pockets 35 that may extend generally horizontally across most of the width of front wall 13. Pockets 35 are preferably defined by seams 31 and 33 so as to have open ends 35-1 and 35-2; however, pockets 35 may be selectively closed by strips of VELCRO complementary hook and loop fasteners 36-1 and 36-2 located on opposing faces of sheets 25 and 27 at each of ends 35-1 and 35-2. In this manner, as will be discussed below, temperature-control members may be removably and securely disposed within pockets 35.

A strip of VELCRO fasteners 23-2 may be secured to the rear of sheet 27 near its top edge (i.e., in the area uncovered by the top edge of sheet 25) for detachable joining to a strip of complementary VELCRO fasteners 23-1 provided as part of top wall 21 (see FIG. 1(*c*)), and additional strips of VELCRO fasteners 24-1 may be secured to the rear of sheet 27 near its left and right edges (i.e., in the areas uncovered by the left and right edges of sheet 27) for detachable joining to strips of complementary VELCRO fasteners 24-2 provided as parts of left wall 17 and right wall 19 (see FIG. 1(*c*)). Preferably, VELCRO fasteners 23-1 and 23-2 and VELCRO fasteners 24-1 and 24-2 are appropriately positioned on their respective walls so that, when such walls are joined together thereby, the pockets 35 of one wall come into close proximity with the pockets 35 of the wall joined thereto. In this manner, as will be apparent from the discussion below, it is possible for the contents of pockets 35 in neighboring walls to be brought into close proximity to one another, thereby minimizing the gap between temperature-control members of neighboring walls.

Figure 3A:
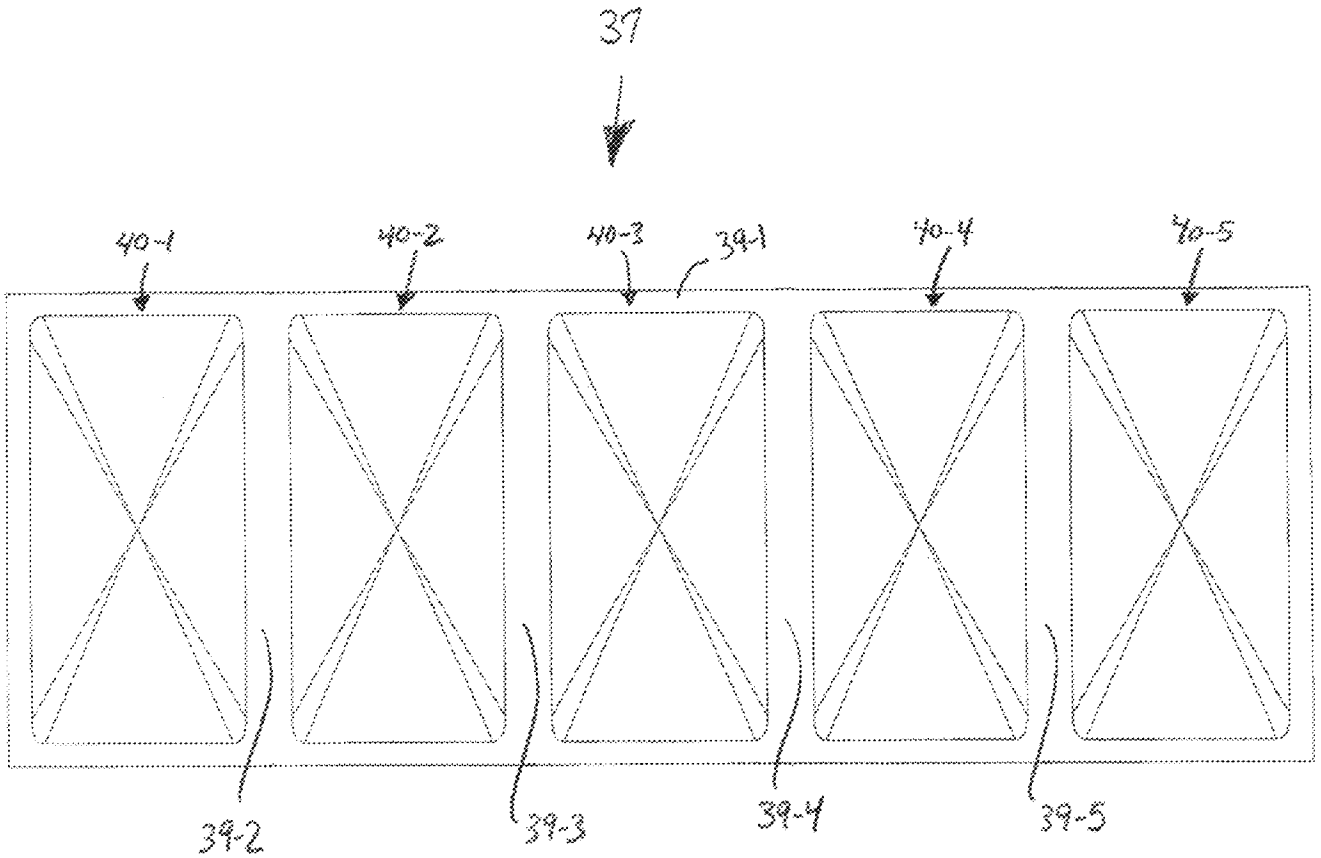
FIGS. 3(*a*) and 3(*b*) are front and enlarged section views of one of the temperature-control members shown in FIG. 2(*a*)
Figure 3B:
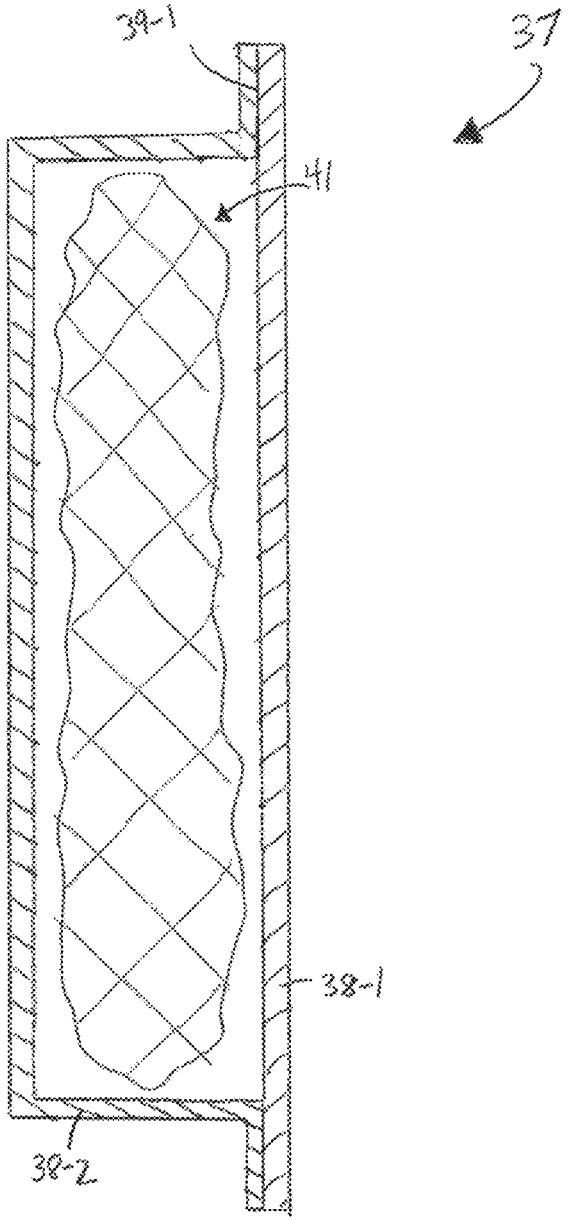

Front wall 13 may further comprise a plurality of temperature-control members 37. Each temperature-control member 37, which is also shown separately in FIGS. 3(*a*) and 3(*b*), may be appropriately dimensioned to occupy a portion of or substantially the entirety of one of pockets 35. Temperature-control member 37 may take a variety of different forms. According to one embodiment, temperature-control member 37 may comprise a pair of flexible polymer films 38-1 and 38-2. Film 38-1 may be flat, and film 38-2 may be shaped, for example, by thermoforming to include a plurality of troughs. Films 38-1 and 38-2 may then be joined to one another, for example, by heat-sealing along the respective peripheries of films 38-1 and 38-2 to define a peripheral seam 39-1 and also in the areas corresponding to the spaces between adjacent troughs to define a plurality of inner seams 39-2 through 39-5, thereby defining a plurality of sealed pouches 40-1 through 40-5. As can be appreciated, temperature-control member 37 may be made by a continuous process. It is to be understood that the number and shape of pouches 40-1 through 40-5 that are shown in FIG. 3(*a*) are merely illustrative and that the number and shape of pouches 40-1 through 40-5 may be varied while still coming within the scope of the present invention. A quantity of a phase-change material 41 may be positioned within each of sealed pouches 40-1 through 40-5 prior to the joining together of films 38-1 and 38-2. According to one embodiment, films 38-1 and 38-2 and phase-change material 41 may have a combined weight of approximately 11 ounces. Phase-change material 41 may be any phase-change material including any water-based or organic phase-change material. Solely for purposes of illustration, phase-change material 41 may comprise, in a particular embodiment, a gelled organic phase-change material of the type disclosed in U.S. Patent Application Publication No. US 2014/0290285 A1, inventors Formato et al., published Oct. 2, 2014, the disclosure of which is incorporated herein by reference. More specifically, such a phase-change material may be formed by mixing one or more n-alkanes, such as n-tetradecane (C14), n-pentadecane (C15), n-hexadecane (C16) and n-octadecane (C18), with a gelling agent in the form of a styrene-ethylene-butylene-styrene triblock copolymer or a styrene-ethylene-propylene-styrene triblock copolymer. Examples of the aforementioned gelling agent may include one or more of Kraton™ G1651 copolymer (a high molecular weight SEBS tri-block copolymer with a styrene:rubber ratio of 30:70% by weight), Kraton™ G1654 copolymer (a high molecular weight SEBS tri-block copolymer with a styrene:rubber ratio of 33:67% by weight), or Kraton™ G1660 copolymer (an SEBS tri-block copolymer with a styrene:rubber ratio of 31:69% by weight), or an SEPS copolymer, such as, but not limited to, SEPTON™ 52005 copolymer (a high molecular weight SEPS tri-block copolymer with a styrene:rubber ratio of 20:80% by weight). The mixing of the above-described one or more n-alkanes and the above-described gelling agent may take place at a first temperature at which the at least one n-alkane is in a liquid state and which is below the flashpoint of the at least one n-alkane and at which the mixture is not a viscoelastic liquid, whereby a non-homogeneous mixture is produced; then, heating the non-homogenous mixture to a second temperature that is below the flashpoint of the at least one n-alkane and at which a viscoelastic liquid is formed; and, then, cooling the viscoelastic liquid to room temperature.

Examples of gelled organic phase-change materials that may be suitable for use as phase-change material 41 may include the following:

| Example No. | Phase-Change Temperature | % N-Alkane | Composition of N-Alkane(s) | % Gelling Agent | Composition of Gelling Agent |
|---|---|---|---|---|---|
| 1 | 3° C. | 92.6% | 96.5% C14 and 3.5% C16 | 7.4% | Kraton ™ G1654 powder |
| 2 | 3° C. | 92.6% | 98.5% C14 and 1.5% C16 | 7.4% | Kraton ™ G1654 powder |
| 3 | 5° C. | 92.6% | 100% C14 | 7.4% | Kraton ™ G1654 powder |
| 4 | 7° C. | 92.6% | 38.2% C14 and 61.8% C16 | 7.4% | Kraton ™ G1654 powder |
| 5 | 7° C. | 92.6% | 16% C14 and 84% C15 | 7.4% | Kraton ™ G1654 powder |
| 6 | 17° C. | 92.6% | 100% C16 | 7.4% | Kraton ™ G1654 powder |
| 7 | 24° C. | 92.6% | 10.5% C16 and 89.5% C18 | 7.4% | Kraton ™ G1654 powder |

The gelled organic phase-change materials of the above-identified Examples were prepared by placing the above-described mixtures into a pre-heated oven operating at 50°

C. for a period of approximately 2.5 hours and then removing the mixtures from the oven and allowing the mixtures to cool to room temperature. Some of the properties of temperature-control members including the resulting mixtures are presented below.

| Example No. | Avg. Thickness (inches) | Measured THAW Phase-Change Temp (Deg C.) | Measured FREEZE Phase-Change Temp (Deg C.) | 12 Freeze/Thaw Cycle Syneresis (% weight) | Compressive Modulus (psi) |
|---|---|---|---|---|---|
| 1 | 0.466 | 4.18 | 1.89 | 0.0 | Not tested |
| 2 | 0.473 | 4.26 | 3.28 | 0.0 | Not tested |
| 3 | 0.508 | 5.27 | 4.27 | <0.5 (8 cycles) | 4.09 |
| 4 | 0.479 | 7.78 | 7.79 | 0.0 | Not tested |
| 5 | 0.502 | 7.42 | 7.03 | 0.0 | Not tested |
| 6 | 0.475 | 17.46 | 16.95 | 0.0 | Not tested |
| 7 | Not tested | Not tested | Not tested | Not tested | Not tested |

Gelled organic phase-change materials of the type described above possess many desirable attributes. For example, such gelled materials are capable of conforming to virtually any shaped pouch or other receptacle therefor while, at the same time, being less susceptible to leaking than liquid phase-change materials. In addition, such gelled materials possess good shock absorption and, therefore, provide physical protection to a payload covered thereby. Additionally, such gelled materials are capable of surviving many freeze/thaw cycles while maintaining good performance as a phase-change material. Moreover, such gelled materials possess excellent compression strength—even when placed under a payload (as in certain embodiments discussed below). Furthermore, the above-described gelled phase-change materials tend to cover more surface area of a product load than do an equivalent amount of a liquid phase-change material, especially when the phase-change material is oriented vertically. This is because liquid phase-change materials tend to flow to the bottom of the receptacle containing the liquid phase-change material. Consequently, orienting the receptacle vertically tends to cause a significant portion of the liquid phase-change material to pool at the bottom of the receptacle. (This problem may persist, albeit to a lesser extent, even if the receptacle is oriented horizontally.) By contrast, the subject gelled materials tend not to flow much, if at all, to the bottom of a receptacle therefor.

In a preferred embodiment, a quantity of phase-change material 41 may be contained within each of pouches 40-1 through 40-5, the contents of pouches 40-1 through 40-5 being sealed from one another. Preferably, each of pouches 40-1 through 40-5 contains approximately the same quantity of the same type of phase-change material 41. Notwithstanding the above, it is to be understood that different pouches 40-1 through 40-5 of a given temperature-control member 37 may contain different types and/or quantities of phase-change material and/or that certain pouches 40-1 through 40-5 of a given temperature-control member 37 may contain phase-change material whereas other pouches 40-1 through 40-5 of the same temperature-control member 37 may be devoid of phase-change material. It is also to be understood that different temperature-control members 37 employed in front wall 13 may contain different types and/or quantities of phase-change material and/or that different walls may contain different types and/or quantities of phase-change material. Also, it is to be understood that certain pockets 35 of front wall 13 may be entirely devoid of a temperature-control member 37 or of any other contents whereas other pockets 35 of front wall 13 may contain one or more temperature-control members 37. Consequently, if desired, one may have phase-change material 41 positioned across a substantial portion of the surface area of front wall 13 (although phase-change material 41 is not present in those areas corresponding to the seams 39-1 through 39-5 of temperature-control members 37 or in those areas corresponding to the seams between pockets 35). Alternatively, if desired, one may have a more uneven distribution of phase-change material 41 across the surface area of front wall 13, such as by positioning greater amounts of phase-change material in the corner regions of front wall 13 and lesser or no amounts of phase-change material in the central regions of front wall 13 or by positioning greater amounts of phase-change material in the upper portion of front wall 13 and lesser or no amounts of phase-change material in the lower portion of front wall 13.

Front wall 13 may further comprise along its bottom edge one or more closure devices 43, such as straps, clips, hooks, or the like, that may be used to secure front wall 13 to a pallet P. Pallet P may be a conventional wooden or plastic pallet. Alternatively, pallet P may be a thermally insulated pallet, such as an AIRDEX pallet, which is commercially available from Foam Fabricators, Modesto, Calif. An AIRDEX pallet typically contains 2+ inches of expanded polystyrene insulation. The use of a thermally insulated pallet may obviate the desirability, in certain cases, of positioning an insulating material and/or a phase-change material below the payload.

Figure 4:
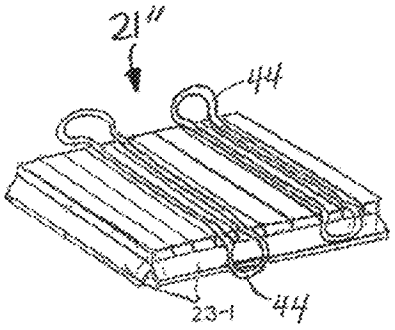
FIG. 4 is a perspective view of a second alternative top wall for use in the pallet cover of FIG. 1.

As noted above, rear wall 15, left wall 17, right wall 19, and top wall 21 may have a construction generally similar to that of front wall 13. (Top wall 21 may be devoid of straps 43; however, another alternative embodiment of top wall 21, namely, top wall 21" (see FIG. 4) includes one or more looped handles 44 to facilitate the lifting and movement of top wall 21".) Each of rear wall 15, left wall 17, right wall 19, and top wall 21 may possess any of the variations of the types described above in connection with front wall 13, and each of front wall 13, rear wall 15, left wall 17, right wall 19, and top wall 21 may possess any such variations independently of one another.

As alluded to above, pallet cover 11 may additionally comprise a bottom wall for placement under the payload. Said bottom wall may comprise a layer of insulation and/or a phase-change material. If a phase-change material is used, such a phase-change material is preferably a gelled organic phase-change material of the type described above.

Figure 5:
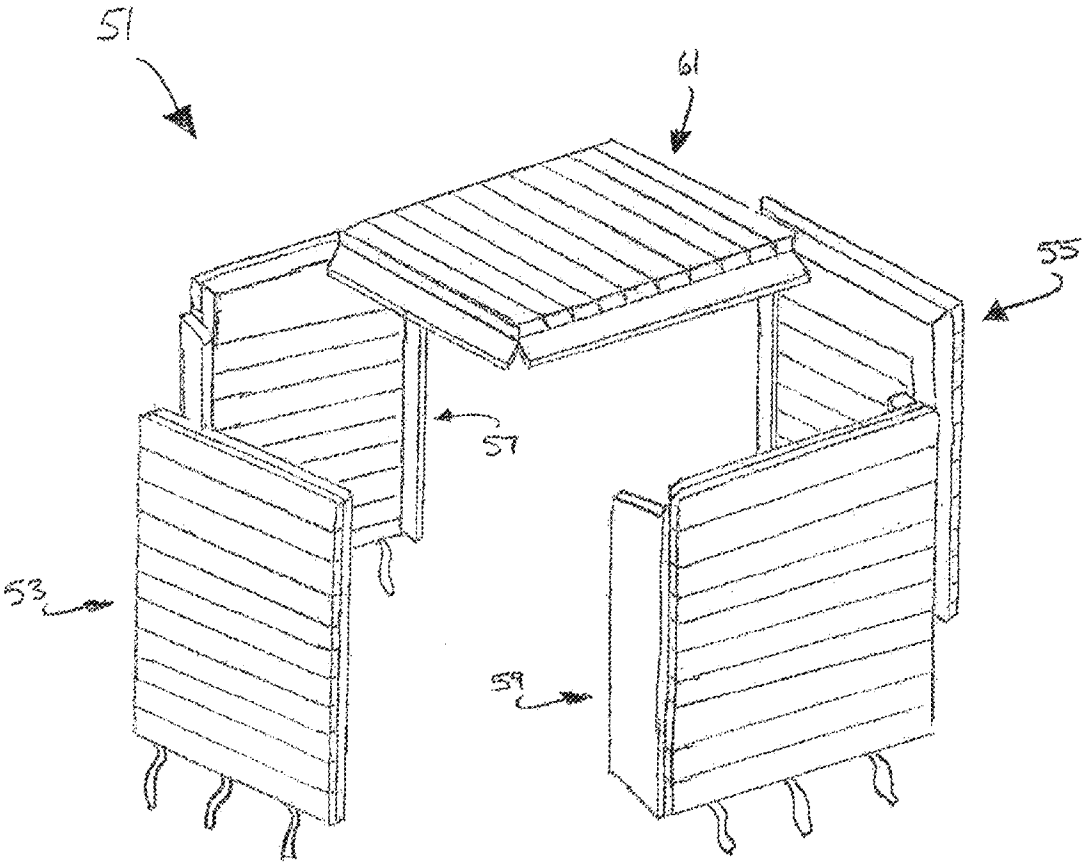
FIG. 5 is a partly exploded perspective view of a second embodiment of a pallet cover constructed according to the teachings of the present invention.

Referring now to FIG. 5, there is shown is a partly exploded perspective view of a second embodiment of a pallet cover constructed according to the teachings of the present invention, the pallet cover being represented generally by reference numeral 51.

Pallet cover 51 may be similar in most respects to pallet cover 11, the principal difference between the two pallet covers being that, whereas pallet cover 11 may include front wall 13, rear wall 15, left wall 17, right wall 19, and top wall 21, pallet cover 51 may comprise a front wall 53, a rear wall 55, a left wall 57, a right wall 59, and a top wall 61. As seen best in FIG. 6, front wall 53 of pallet cover 51 may differ principally from front wall 13 of pallet cover 11 in that front wall 53 may further comprise an outer layer of thermal insulation 63 and a third fabric sheet 65. Outer layer of insulation 63, which may be any suitable thermally-insulating material, such as, but not limited to, a metalized polyester or a bubble wrap with a metalized polyethylene terephthalate layer applied thereto, may be positioned on the outside surface of outwardly-facing fabric sheet 27, and third fabric sheet 65 may be positioned on the outside surface of insulation 63. If desired, third fabric sheet 65 may be sewn to fabric sheets 25 and 27 along seams 31 and 33. In another embodiment (not shown), insulation 63, may be positioned between temperature-control members 37 and outwardly-facing fabric sheet 27, and third fabric sheet 65 may be omitted.

Rear wall 55, left wall 57, right wall 59, and top wall 61 may have a construction generally similar to that of front wall 53 (it being understood that top wall 61 may be devoid of straps 43 and may include looped handles as in top wall 21'). Each of rear wall 55, left wall 57, right wall 59, and top wall 61 may possess any of the variations of the types described above in connection with front wall 53, and each of front wall 53, rear wall 55, left wall 57, right wall 59, and top wall 61 may possess any such variations independently of one another.

Figure 7:
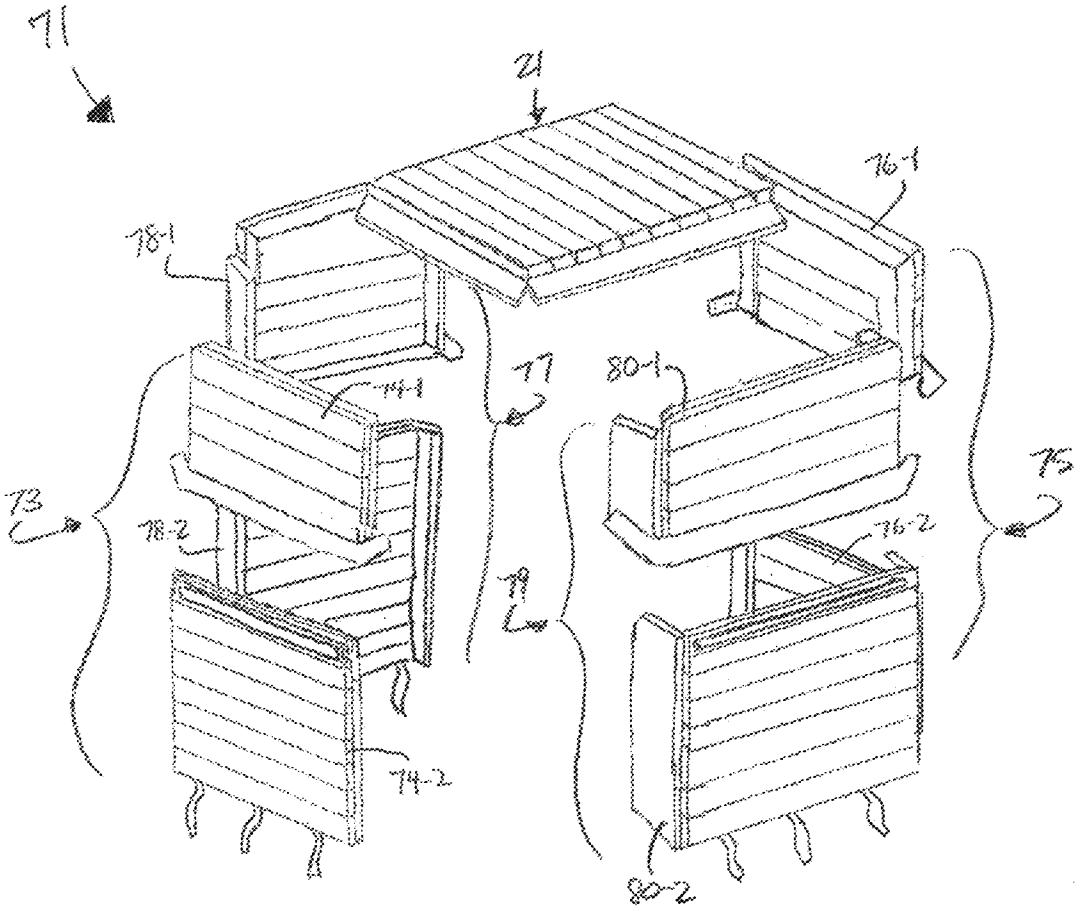
FIG. 7 is a partly exploded perspective view of a third embodiment of a pallet cover constructed according to the teachings of the present invention.

Referring now to FIG. 7, there is shown a partly exploded perspective view of a third embodiment of a pallet cover constructed according to the teachings of the present invention, the pallet cover being represented generally by reference numeral 71.

Figure 6:
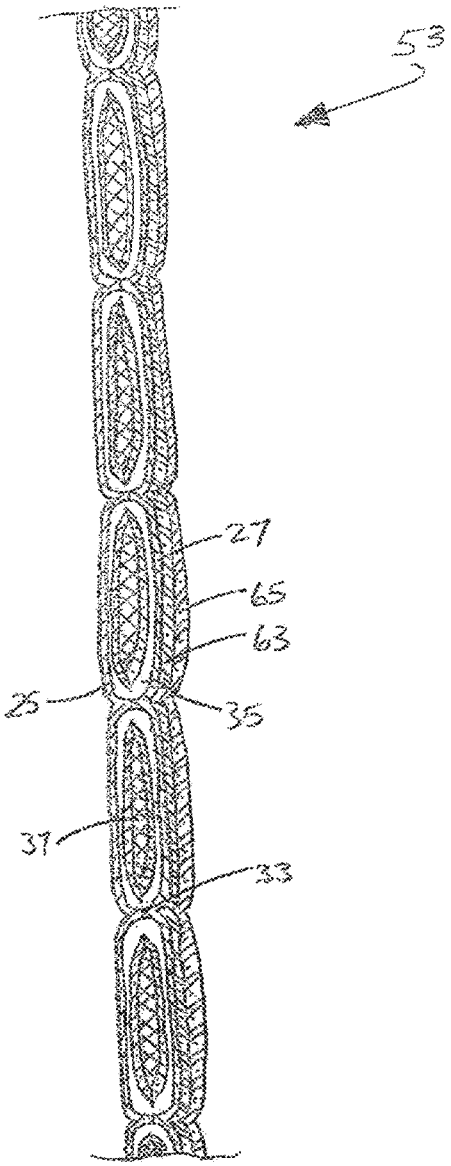
FIG. 6 is an enlarged fragmentary section view of the front wall shown in FIG. 5.

Pallet cover 71 may be similar in most respects to pallet cover 11, the principal difference between the two pallet covers being that, whereas each of front wall 13, rear wall 15, left wall 17, and right wall 19 of pallet cover 11 may be constructed as a unitary structure, pallet cover 71 may comprise a front wall 73, a rear wall 75, a left wall 77, and a right wall 79, each of which may be constructed as a two-piece structure that may be detachably joined together, for example, using complementary strips of VELCRO hook and loop fasteners or another type of releasable fastener. Consequently, front wall 73 may comprise a first portion 74-1 and a second portion 74-2, rear wall 75 may comprise a first portion 76-1 and a second portion 76-2, left wall 77 may comprise a first portion 78-1 and a second portion 78-2, and right wall 79 may comprise a first portion 80-1 and a second portion 80-2. In the embodiment of FIG. 6, first portions 74-1, 76-1, 78-1 and 80-2 may be detachably joined to top wall 21 using, for example, complementary strips of VELCRO hook and loop fasteners or another type of releasable fastener, and second portions 74-2, 76-2, 78-2 and 80-2 may be detachably joined to first portions 74-1, 76-1, 78-1 and 80-1 using complementary strips of VELCRO hook and loop fasteners or another type of releasable fastener. In a similar fashion, neighboring first portions 74-1, 76-1, 78-1 and 80-1 may be detachably joined to one another using complementary strips of VELCRO hook and loop fasteners or another type of releasable fastener, and neighboring second portions 74-2, 76-2, 78-2 and 80-2 may be detachably joined to one another using complementary strips of VELCRO hook and loop fasteners or another type of releasable fastener.

As can readily be appreciated, the positions of first portions 74-1, 76-1, 78-1 and 80-1 and second portions 74-2, 76-2, 78-2 and 80-2, respectively, may be switched so that second portions 74-2, 76-2, 78-2 and 80-2 are detachably joined directly to top wall 21, with first portions 74-1, 76-1, 78-1 and 80-1 being detachably joined to second portions 74-2, 76-2, 78-2 and 80-2, at a location distal to top wall 21. As can also be appreciated, first portions 74-1, 76-1, 78-1 and 80-1 may be detachably joined directly to top wall 21, without joining second portions 74-2, 76-2, 78-2 and 80-2 to top wall 21 or to first portions 74-1, 76-1, 78-1 and 80-1, respectively, so as to form corresponding walls of reduced length. In an analogous fashion, second portions 74-2, 76-2, 78-2 and 80-2 may be detachably joined directly to top wall 21, without joining first portions 74-1, 76-1, 78-1 and 80-1 to top wall 21 or to second portions 74-2, 76-2, 78-2 and 80-2, respectively, so as to form corresponding walls of reduced length. If both first portions 74-1, 76-1, 78-1 and 80-1 and second portions 74-2, 76-2, 78-2 and 80-2 are joined to top wall 21, regardless of whether first portions 74-1, 76-1, 78-1 and 80-1 are directly joined to top wall 21 or second portions 74-2, 76-2, 78-2 and 80-2 are directly joined to top wall 21, both sets of portions may be partially or fully equipped with temperature-control members 37; alternatively, the portions more distal to top wall 21 may be completely devoid of temperature-control members 37 whereas the portions more proximal to top wall 21 may be partially or fully equipped with temperature-control members 37.

Pallet cover 71 may be modified by incorporating a layer of thermal insulation into one or more of top wall 21, front wall 73, rear wall 75, left wall 77, and right wall 79 in a manner similar to that described above in connection with pallet cover 51.

Figure 8:
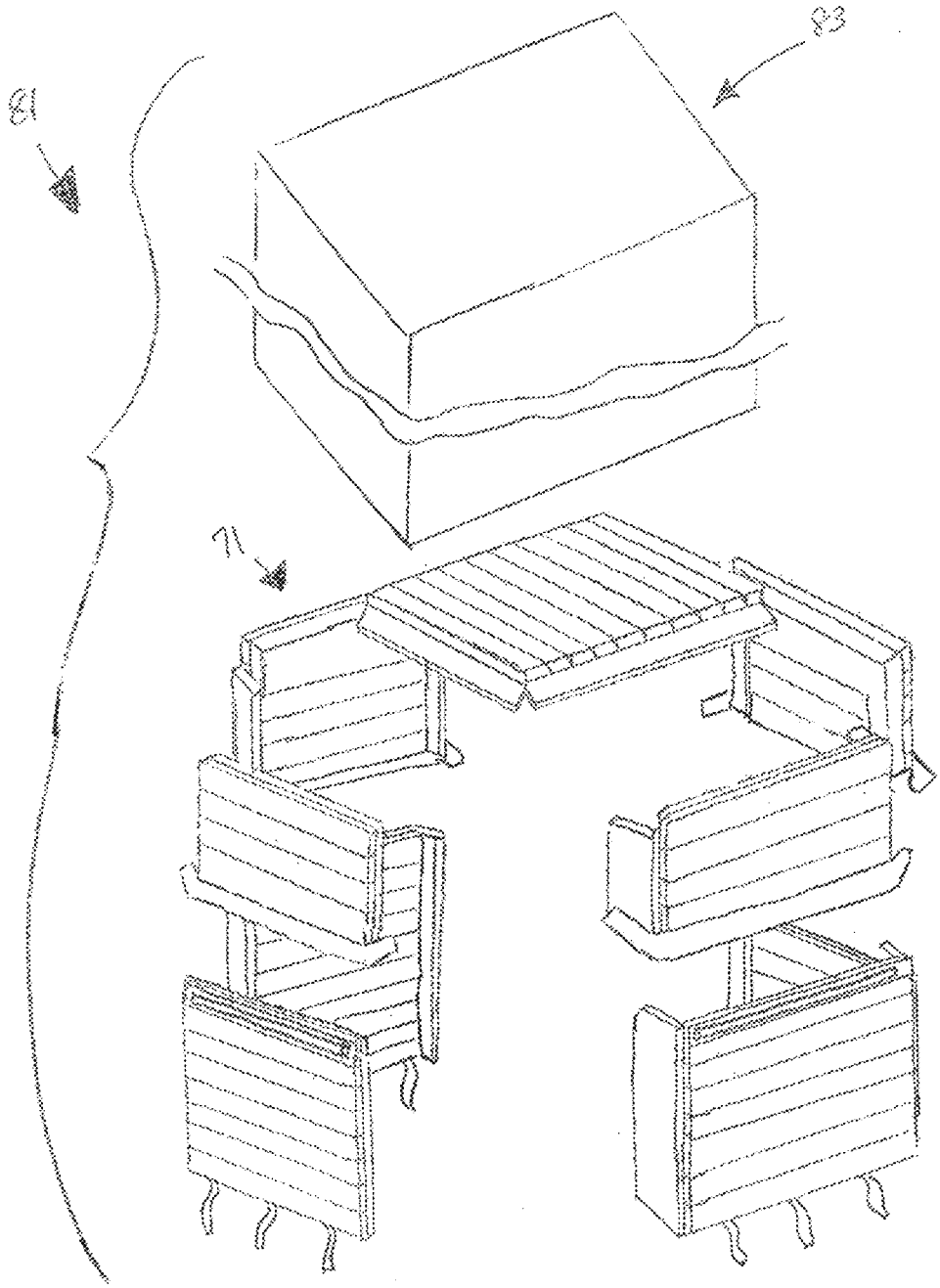
FIG. 8 is a partly exploded perspective view of a fourth embodiment of a pallet cover constructed according to the teachings of the present invention.

Referring now to FIG. 8, there is shown a perspective view of a fourth embodiment of a pallet cover constructed according to the teachings of the present invention, the pallet cover being represented generally by reference numeral 81.

Pallet cover 81 may be similar in many respects to pallet cover 71, the principal difference between the two pallet covers being that pallet cover 81 may comprise, in addition to pallet cover 71, a thermal insulation wrap 83 that may be removably inserted over pallet cover 71. Wrap 83, which may be shaped to cover the top, front, rear, left side and right side of pallet cover 71 while having an open bottom, may be a laminated structure and may comprise, for example, one or more layers of metalized plastic. An example of a suitable material for use as wrap 83 may include a laminate comprising a polyethylene terephthalate layer, a polypropylene layer, and an aluminum layer, such a laminate being commercially available from Trip & Co. (Nieuw-Vennep, The Netherlands) as GoodCape Extreme. Other suitable laminates may include combinations of polyethylene, aluminum and airbubble foil layers (e.g., GoodCape Standard, Trip & Co.) and combinations of aluminum, nonwoven, and polypropylene layers (e.g., GoodCape Light, Trip & Co.).

Thermal insulation wrap 83 may also be used in combination with pallet cover 11, pallet cover 51 and any of the variations thereto discussed herein.

As noted above, it may be desirable in certain situations to have a non-uniform distribution of phase-change material along one or more faces of the payload. In particular, it may be desirable to have greater quantities of phase-change material along the edges of each face of the payload since these areas are often the most vulnerable to temperature excursions. One example of such an approach is discussed below.

Figure 9:
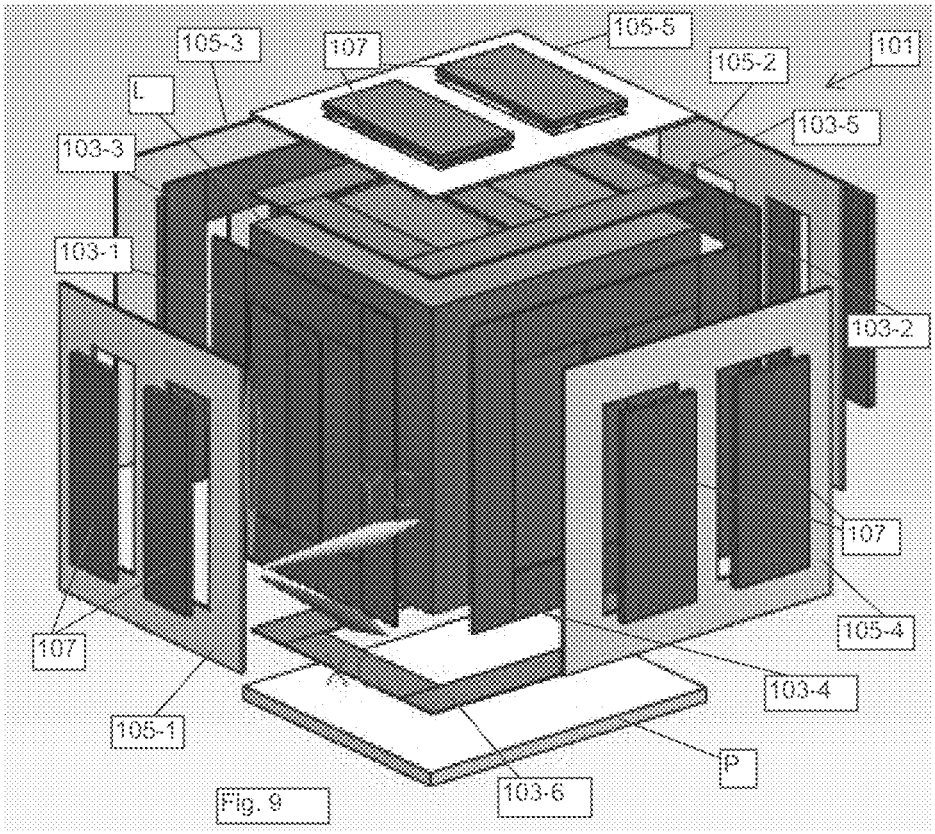
FIG. 9 is a partly exploded perspective view of a fifth embodiment of a pallet cover constructed according to the teachings of the present invention, the fabric sheets of the pallet cover not being shown to reveal the internal components of the pallet cover, the pallet cover being shown in combination with a payload on a pallet.

Referring now to FIG. 9, there is shown a partly exploded perspective view of a fifth embodiment of a pallet cover constructed according to the teachings of the present invention, the pallet cover being represented generally by reference numeral 101. It should be noted that, in FIG. 9, the fabric sheets of pallet cover 101 are not shown to reveal the internal components of pallet cover 101. It should also be noted that pallet cover 101 is shown in FIG. 9 in combination with a 40 inch by 48 inch payload L on a pallet P.

Pallet cover 101 may comprise a plurality of temperature-control assemblies 103-1 through 103-5 that may be positioned along the front, rear, left side, right side, and top surfaces, respectively, of the payload L. Each of temperature-control assemblies 103-1 through 103-5 may comprise a plurality of temperature-control members, each of which may be generally similar in structure to temperature-control member 37. A plurality of temperature-control members of each of assemblies 103-1 through 103-5 may be arranged to form a bifurcated windowpane structure that may be aligned generally with the top, left side, right side and bottom edges of its respective payload surface, with an additional temperature-control member extending from the top temperature-control member to the bottom temperature-control member at their respective midpoints. The above-described construction of assemblies 103-1 through 103-5 provides optimal protection to the areas of payload L most vulnerable to temperature excursions.

Pallet cover 101 may additionally comprise a temperature-control assembly 103-6 to be positioned below payload L. Temperature-control assembly 103-6 may differ from temperature-control assembly 103-1 through 103-5 in that temperature-control assembly 103-6 may omit the temperature-control member that corresponds to the temperature-control member extending from the top temperature-control member to the bottom temperature-control member at their respective midpoints.

It is to be understood that each of temperature-control assemblies 103-1 through 103-6 may comprise, independently of one another, a single type of temperature-control member or may comprise a plurality of different types of temperature-control members that may vary from one another in phase-change material composition, quantity and/or dimensions.

Pallet cover 101 may further comprise a plurality of thermal insulation members 105-1 through 105-5. Insulation members 105-1 through 105-5, which may be made of bubblewrap or any other similarly suitable insulating material, may be aligned with and placed in contact with the outwardly-facing surfaces of temperature-control assemblies 103-1 through 103-5, respectively.

Pallet cover 101 may further comprise a plurality of thermal insulation members 107. Insulation members 107, which may be made of a flexible polyurethane foam, may be positioned in the spaces within temperature-control assemblies 103 and insulation members 105. Preferably, the combined thickness of each set of temperature-control assembly 103 and insulation member 105 is approximately equal to the thickness of insulation members 107.

Without wishing to be limited to any particular dimensions, the temperature-control members used to form temperature-control assemblies 103-1 through 103-5 may be approximately 7 inches wide and approximately ½ inch thick, insulation members 105-1 through 105-5 may be approximately ½ inch thick, and insulation members 107 may be approximately 1 inch thick.

In another embodiment (not shown), insulation members 105-1 through 105-5 of pallet cover 101 may be replaced with additional temperature-control assemblies that may be the same as or different from temperature-control assemblies 103-1 through 103-5. Moreover, in such an alternative embodiment, the two layers of temperature-control assemblies may not have a windowpane configuration, but rather, may simply be a solid rectangular shape, and insulating members 107 may be omitted.

It is to be understood that thermal insulation wrap 83 could also be removably inserted over pallet cover 101 or the variations thereto discussed herein.

Figure 10:
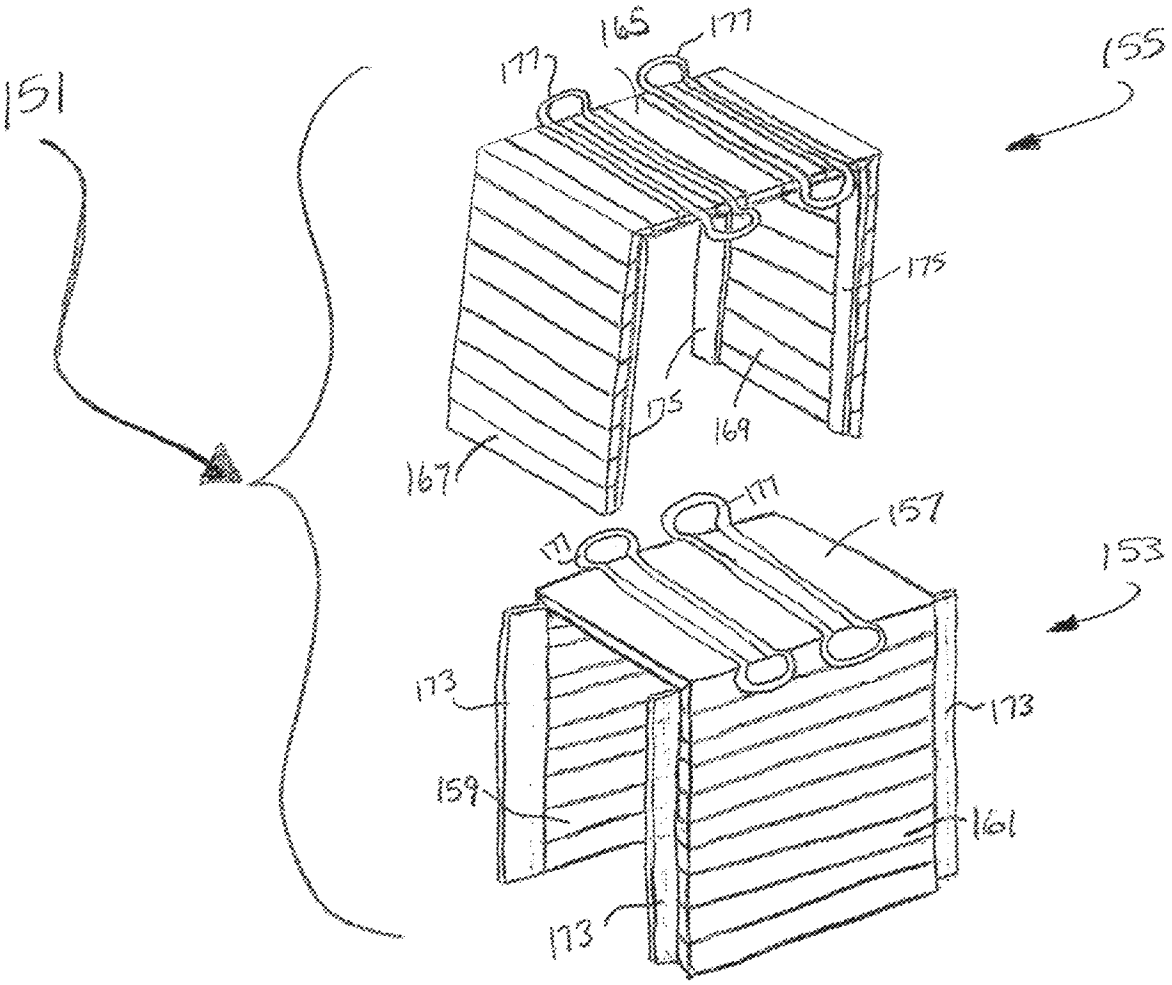
FIG. 10 is a partly exploded perspective view of a sixth embodiment of a pallet cover constructed according to the teachings of the present invention.

Referring now to FIG. 10, there is shown a partly exploded perspective view of a sixth embodiment of a pallet cover constructed according to the teachings of the present invention, the pallet cover being represented generally by reference numeral 151.

Pallet cover 151 may comprise a first assembly 153 and a second assembly 155. First assembly 153 may comprise a central panel 157 and a pair of end panels 159 and 161. First assembly 153 may be constructed so that end panels 159 and 161 are integrally formed with and extend from opposite ends of central panel 157. Central panel 157 may be similar in size, shape and construction to top wall 21 of pallet cover 11, except that top wall 21 need not include any pockets 35. End panels 159 and 161 may be similar in size, shape and construction to left side wall 17 and right side wall 19, respectively, of pallet cover 11.

Second assembly 155 may comprise a central panel 165 and a pair of end panels 167 and 169. Second assembly 155 may be constructed so that end panels 167 and 169 are integrally formed with and extend from opposite ends of central panel 165. Central panel 165 may be similar in size, shape and construction to top wall 21 of pallet cover 11, and end panels 167 and 169 may be similar in size, shape and construction to front wall 13 and rear wall 15, respectively, of pallet cover 11.

Strips 173 and 175 of VELCRO complementary hook and loop fasteners may be positioned on or proximate to the lateral edges of end panels 159, 161, 167 and 169 so that end panel 159 may be fastened to each of end panels 167 and 169 and so that end panel 161 may be fastened to each of end panels 167 and 169. In this manner, first assembly 153 and second assembly 155 may be detachably joined to one another. Other types of detachable fasteners, such as, but not limited to, zippers, buttons, snaps, releasable adhesive tapes, and the like may be used in addition to or instead of the aforementioned VELCRO complementary hook and loop fasteners. In another embodiment, one or more portions of first assembly 153 and second assembly 155 may be permanently secured to one another, for example, using rivets, stitching, a permanent adhesive or the like. Alternatively, first assembly 153 and second assembly 155 may be secured to one another with a combination of detachable fasteners and permanent fasteners.

One or both of central panels 157 and 165 may be provided with looped handles 177 similar to looped handles 44, and one or more of end panels 159, 161, 167 and 169 may be provided with straps (not shown) similar to straps 43.

As can also be appreciated, one or both of assemblies 153 and 155 may be modified in one or more of the panels thereof to include an insulation layer of the type shown in FIG. 6.

As can also be appreciated, one or both of assemblies 153 and 155 may be modified to further include an additional panel or other structure that may be positioned below the payload. Such a structure may include, but need not include, a temperature-control member as described above. Alternatively, the structure for positioning under the payload may be a physically discrete structure from assemblies 153 and 155.

As can further be appreciated, pallet cover 151 may be used in combination with thermal insulation wrap 83.

Figure 11:
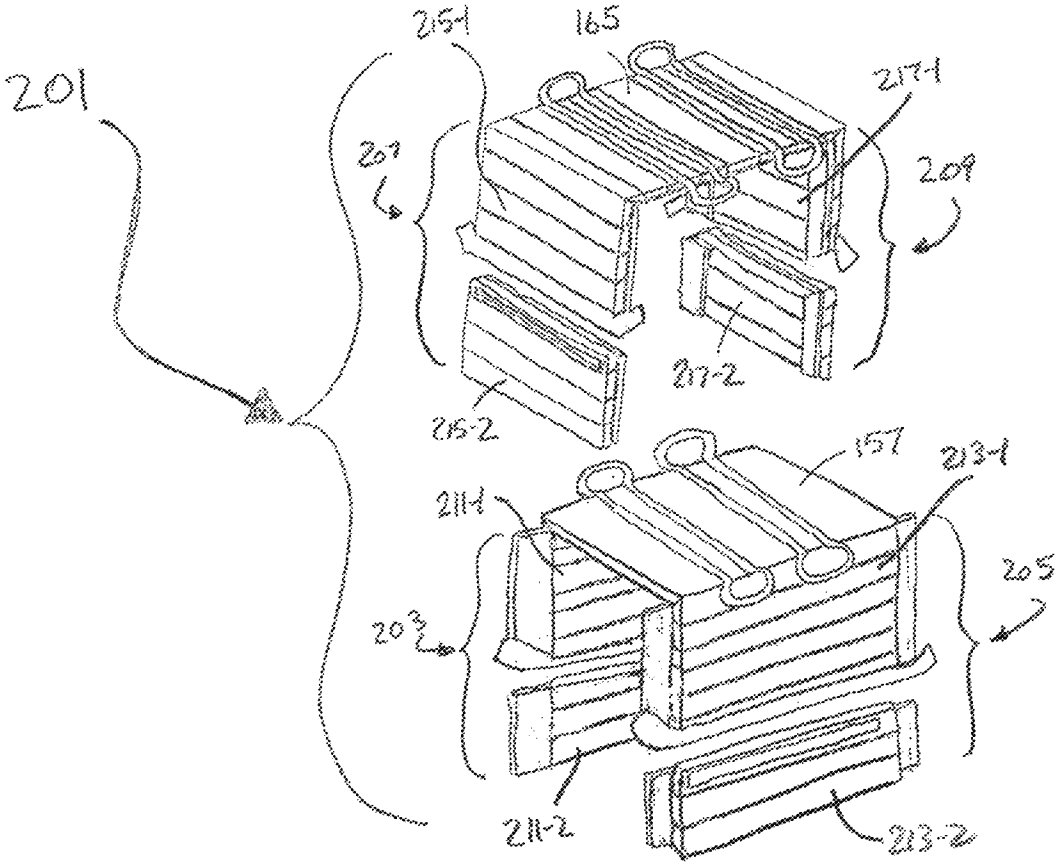
FIG. 11 is a partly exploded perspective view of a seventh embodiment of a pallet cover constructed according to the teachings of the present invention.

Referring now to FIG. 11, there is shown a partly exploded perspective view of a seventh embodiment of a pallet cover constructed according to the teachings of the present invention, the pallet cover being represented generally by reference numeral 201.

Cover 201 may be similar in many respects to cover 151, the principal difference between the two covers being that, whereas each of end panels 159, 161, 167 and 169 of cover 151 may be constructed as a unitary structure, pallet cover 201 may comprise end panel 203, 205, 207 and 209, each of which may be constructed as a two-piece structure that may be detachably joined together, for example, using complementary strips of VELCRO hook and loop fasteners or another type of releasable fastener. Consequently, end panel 203 may comprise a first portion 211-1 and a second portion 211-2, end panel 205 may comprise a first portion 213-1 and a second portion 213-2, end panel 207 may comprise a first portion 215-1 and a second portion 215-2, and end panel 209 may comprise a first portion 217-1 and a second portion 217-2.

As can further be appreciated, pallet cover 201 may be used in combination with thermal insulation wrap 83.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A pallet cover suitable for use in covering at least a portion of a payload on a pallet, the pallet cover comprising:
(a) a top wall;
(b) a front wall;
(c) a rear wall;
(d) a left side wall; and
(e) a right side wall;
(f) wherein at least one of said top wall, said front wall, said rear wall, said left side wall, and said right side wall comprises an inner fabric sheet, an outer fabric sheet, a first plurality of temperature-control members, and at least one insulating member, the first plurality of temperature-control members being disposed between the inner fabric sheet and the outer fabric sheet and comprising at least one phase-change material, the at least one insulating member being disposed between the inner fabric sheet and the outer fabric sheet and comprising foam insulation, the first plurality of temperature-control members arranged to circumscribe at least one void, the at least one insulating member being positioned within the at least one void.

2. The pallet cover as claimed in claim 1 wherein each of said top wall, said front wall, said rear wall, said left side wall, and said right side wall comprises an inner fabric sheet, an outer fabric sheet, a first plurality of temperature-control members, and a plurality of insulating members, each of the temperature-control members being disposed between the inner fabric sheet and the outer fabric sheet and comprising at least one phase-change material, the temperature-control members of each of said top wall, said front wall, said rear wall, said left side wall and said right wall being arranged to circumscribe two voids, and wherein an insulating member is positioned within each of the two voids and between the inner fabric sheet and the outer fabric sheet, the insulating member comprising foam insulation.

3. The pallet cover as claimed in claim 2 wherein each of said top wall, said front wall, said rear wall, said left side wall and said right side wall further comprises at least one additional insulation member disposed between the inner fabric sheet and the outer fabric sheet, the at least one additional insulation member being arranged similarly to and in contact with the first plurality of temperature-control members.

4. The pallet cover as claimed in claim 2 wherein each of said top wall, said front wall, said rear wall, said left side wall and said right side wall further comprises a second plurality of temperature-control members, the second plurality of temperature-control members being arranged similarly to and in contact with the first plurality of temperature-control members.

5. The pallet cover as claimed in claim 4 wherein the second plurality of temperature-control members comprises a phase-change material and wherein the phase-change material of the second plurality of temperature-control members differs from the phase-change material of the first plurality of temperature-control members.

6. The pallet cover as claimed in claim 1 further comprising a bottom wall, the bottom wall comprising a second plurality of temperature-control members.

7. The pallet cover as claimed in claim 6 wherein each of the second plurality of temperature-control members comprises a phase-change material and wherein the second plurality of temperature-control members are arranged to circumscribe a void.

8. The pallet cover as claimed in claim 7 wherein the void of the bottom wall is unoccupied.

9. The pallet cover as claimed in claim 1 wherein the at least one phase-change material is a gelled organic phase-change material comprising at least one n-alkane and a gelling agent selected from the group consisting of a styrene-ethylene-butylene-styrene triblock copolymer and a styrene-ethylene-propylene-styrene triblock copolymer.

10. The combination of the pallet cover of claim 1 and a thermal insulation wrap, the thermal insulation wrap being removably inserted over the pallet cover.

11. A pallet cover suitable for use in covering at least a portion of a payload on a pallet, the pallet cover comprising:
(a) a top wall;
(b) a front wall;
(c) a rear wall;
(d) a left side wall; and
(e) a right side wall;
(f) wherein each of said top wall, said front wall, said rear wall, said left side wall, and said right side wall comprises (i) an inner fabric sheet, (ii) an outer fabric sheet, (iii) one or more temperature-control members disposed between the inner fabric sheet and the outer fabric sheet, the one or more temperature-control members comprising at least one phase-change material and arranged to form a first windowpane structure, the first windowpane structure having at least one void, and (iv) foam insulation disposed between the inner fabric sheet and the outer fabric sheet and within each of the at least one void.

12. The pallet cover as claimed in claim 11 wherein the first windowpane structure is a bifurcated windowpane structure having two voids.

13. The pallet cover as claimed in claim 11 further comprising a bottom wall, the bottom wall comprising one or more temperature-control members arranged to form a second windowpane structure, the second windowpane structure circumscribing a single void.

14. The pallet cover as claimed in claim 11 wherein each of said top wall, said front wall, said rear wall, said left side wall, and said right side wall further comprises additional insulation disposed between the inner fabric sheet and the outer fabric sheet and arranged correspondingly to the first windowpane structure on an outwardly facing surface thereof.

15. The pallet cover as claimed in claim 14 wherein each of the one or more temperature-control members comprises a pair of films joined together to define a plurality of sealed pouches, each of the sealed pouches containing a quantity of a phase-change material.

16. The pallet cover as claimed in claim 11 wherein the one or more temperature-control members comprise a plurality of temperature-control members having a variety of different phase-change material compositions.

* * * * *